US006180866B1

(12) United States Patent
Kitamura

(10) Patent No.: US 6,180,866 B1
(45) Date of Patent: Jan. 30, 2001

(54) REVERBERATING/RESONATING APPARATUS AND METHOD

(75) Inventor: Mineo Kitamura, Hamamatsu (JP)

(73) Assignee: Kawai Musical Instruments Mfg. Co., Ltd., Shizuoka-ken (JP)

( * ) Notice: Under 35 U.S.C. 154(b), the term of this patent shall be extended for 0 days.

(21) Appl. No.: 09/345,381

(22) Filed: Jun. 30, 1999

(30) Foreign Application Priority Data

Jun. 30, 1998 (JP) ..... 10-184166

(51) Int. Cl.[7] ..... G10H 1/02; G10H 7/00
(52) U.S. Cl. ..... 84/630; 84/662
(58) Field of Search ..... 84/630, 627, 626, 84/662, 663

(56) References Cited

U.S. PATENT DOCUMENTS 5,166,464 * 11/1992 Sakata et al. .
5,241,604 * 8/1993 Noguchi ..... 84/630 X
5,432,856 * 7/1995 Shioda .
5,478,968 * 12/1995 Kitagawa et al. ..... 84/630 X
5,521,325 * 5/1996 Takeuchi et al. ..... 84/630 X

* cited by examiner

*Primary Examiner*—Jeffrey Donels

(57) ABSTRACT

A tone to which resonance characteristics have been added to is repetitively delayed so as to reverberate. The delay of the tone is determined based on the resonance characteristics, and a modified tone in which the reverberation and resonance characteristics are related to one another is generated.

18 Claims, 17 Drawing Sheets

FIG. 2

30

| TONE No. TN | FREQ. No. RATIO FNR | ENV. DATA |
|---|---|---|
| 1 | FNR 1<br>FNR 2<br>FNR 3<br>FNR 4<br>⋮ | SPEED E S 1, TIME E T 1<br>SPEED E S 2, TIME E T 2<br>SPEED E S 3, TIME E T 3<br>SPEED E S 4, TIME E T 4<br>⋮ ⋮ |
| 2 | FNR 1<br>FNR 2<br>FNR 3<br>FNR 4<br>⋮ | SPEED E S 1, TIME E T 1<br>SPEED E S 2, TIME E T 2<br>SPEED E S 3, TIME E T 3<br>SPEED E S 4, TIME E T 4<br>⋮ ⋮ |
| 3 | FNR 1<br>FNR 2<br>FNR 3<br>FNR 4<br>⋮ | SPEED E S 1, TIME E T 1<br>SPEED E S 2, TIME E T 2<br>SPEED E S 3, TIME E T 3<br>SPEED E S 4, TIME E T 4<br>⋮ ⋮ |
| 4 | FNR 1<br>FNR 2<br>FNR 3<br>FNR 4<br>⋮ | SPEED E S 1, TIME E T 1<br>SPEED E S 2, TIME E T 2<br>SPEED E S 3, TIME E T 3<br>SPEED E S 4, TIME E T 4<br>⋮ ⋮ |
| | ⋮ | ⋮ ⋮ |

FIG. 6

35

| DIRECT SOUND / DIRECT SOUND | KEY NO. C 1 | KEY NO. C 1 # | KEY NO. D 1 | KEY NO. D 1 # | ... ... ... | KEY NO. B 6 | KEY NO. C 7 |
|---|---|---|---|---|---|---|---|
| KEY NO. C 1 | — | 0 | 0. 05 | 0. 1 | ... ... ... | 0 | 0. 2 |
| ⋮ | ⋮ | ⋮ | ⋮ | ⋮ | ... ... ... | ⋮ | ⋮ |
| KEY NO. C 2 | 0. 8 | 0 | 0. 1 | 0. 2 | ... ... ... | ⋮ | 0. 3 |
| KEY NO. C 2 # | 0 | 0. 8 | 0 | 0. 1 | ... ... ... | ⋮ | 0 |
| KEY NO. D 2 | 0. 1 | 0 | 0. 8 | 0 | ... ... ... | ⋮ | 0 |
| ⋮ | ⋮ | ⋮ | ⋮ | ⋮ | ... ... ... | ⋮ | ⋮ |
| KEY NO. B 6 | 0 | 0 | 0 | 0 | ... ... ... | — | 0 |
| KEY NO. C 7 | 0. 3 | 0 | 0 | 0 | ... ... ... | 0 | — |

FIG. 8

31

| | RESULTANT RESONANCE RELATION VALUE → | | | |
|---|---|---|---|---|
| MUSICAL FACTORS ↓ | DT1 g1<br>DT2 g2<br>DT3 g3<br>⋮ ⋮<br>DT51 g51<br>DT52 g52<br>DT53 g53<br>⋮ ⋮ | DT1 g1<br>DT2 g2<br>DT3 g3<br>⋮ ⋮<br>DT51 g51<br>DT52 g52<br>DT53 g53<br>⋮ ⋮ | ……<br>……<br>……<br>……<br>……<br>……<br>……<br>…… | DT1 g1<br>DT2 g2<br>DT3 g3<br>⋮ ⋮<br>DT51 g51<br>DT52 g52<br>DT53 g53<br>⋮ ⋮ |
| | DT1 g1<br>DT2 g2<br>DT3 g3<br>⋮ ⋮<br>DT51 g51<br>DT52 g52<br>DT53 g53<br>⋮ ⋮ | DT1 g1<br>DT2 g2<br>DT3 g3<br>⋮ ⋮<br>DT51 g51<br>DT52 g52<br>DT53 g53<br>⋮ ⋮ | ……<br>……<br>……<br>……<br>……<br>……<br>……<br>…… | DT1 g1<br>DT2 g2<br>DT3 g3<br>⋮ ⋮<br>DT51 g51<br>DT52 g52<br>DT53 g53<br>⋮ ⋮ |
| | ⋮<br>⋮<br>⋮ | ⋮<br>⋮<br>⋮ | ⋮<br>⋮<br>⋮ | ⋮<br>⋮<br>⋮ |
| | DT1 g1<br>DT2 g2<br>DT3 g3<br>⋮ ⋮<br>DT51 g51<br>DT52 g52<br>DT53 g53<br>⋮ ⋮ | DT1 g1<br>DT2 g2<br>DT3 g3<br>⋮ ⋮<br>DT51 g51<br>DT52 g52<br>DT53 g53<br>⋮ ⋮ | ……<br>……<br>……<br>……<br>……<br>……<br>……<br>…… | DT1 g1<br>DT2 g2<br>DT3 g3<br>⋮ ⋮<br>DT51 g51<br>DT52 g52<br>DT53 g53<br>⋮ ⋮ |

REVERBERATING/RESONATING APPARATUS AND METHOD

BACKGROUND OF THE INVENTION

1. Field of the Invention

The present invention relates to a reverberating/resonating apparatus and to a method thereof and, particularly, to an apparatus and method for adding resonance and reverberation to a generatied tone.

2. Related Art

A conventional reverberating apparatus employs a delay circuit. A tone that is generated (direct sound) is input to the delay circuit and is delayed (early reflection sound). The delayed output is further fed back to the delay circuit, so that the output is delayed repetitively (late reverberation).

Reverberating apparatuses of this type have been disclosed in Japanese Patent Applications Nos. 29477/1996, 46158/1996, 46159/1996 and 57174/1996, for example. An apparatus for adding resonance sound has been disclosed in Japanese Patent Application No. 314818/1989 (Japanese Unexamined Patent Publication (Kokai) No. 174590/1991).

However, these reverberating apparatuses add reverberation without establishing any relationship between the reverberation and the resonance. If the reverberation characteristics can be related to the resonance characteristics, there can be musical tones that are generated with a plurality of variations.

SUMMARY OF THE INVENTION

The object of the present invention is to generate musical tones by establishing a relationship between the reverberation characteristics and the resonance characteristics. According to the present invention, a tone to which resonance characteristics are added is repetitively delayed so as to be imparted with reverberation, and the delay period of the tone is determined based upon the resonance characteristics. This makes it possible to generate a tone having reverberation characteristics and resonance characteristics that are related to each other.

BRIEF DESCRIPTION OF THE DRAWINGS

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 2 illustrates a component sound table 30 in a program/data storage unit 3;

FIG. 6 shows a table 35 of resonance relation values in the program/data storage unit 3;

FIG. 8 shows a reverberation table 31;

DETAILED DESCRIPTION OF THE PREFERRED EMBODIMENT

1. Outline of the Embodiment

Figure 16:
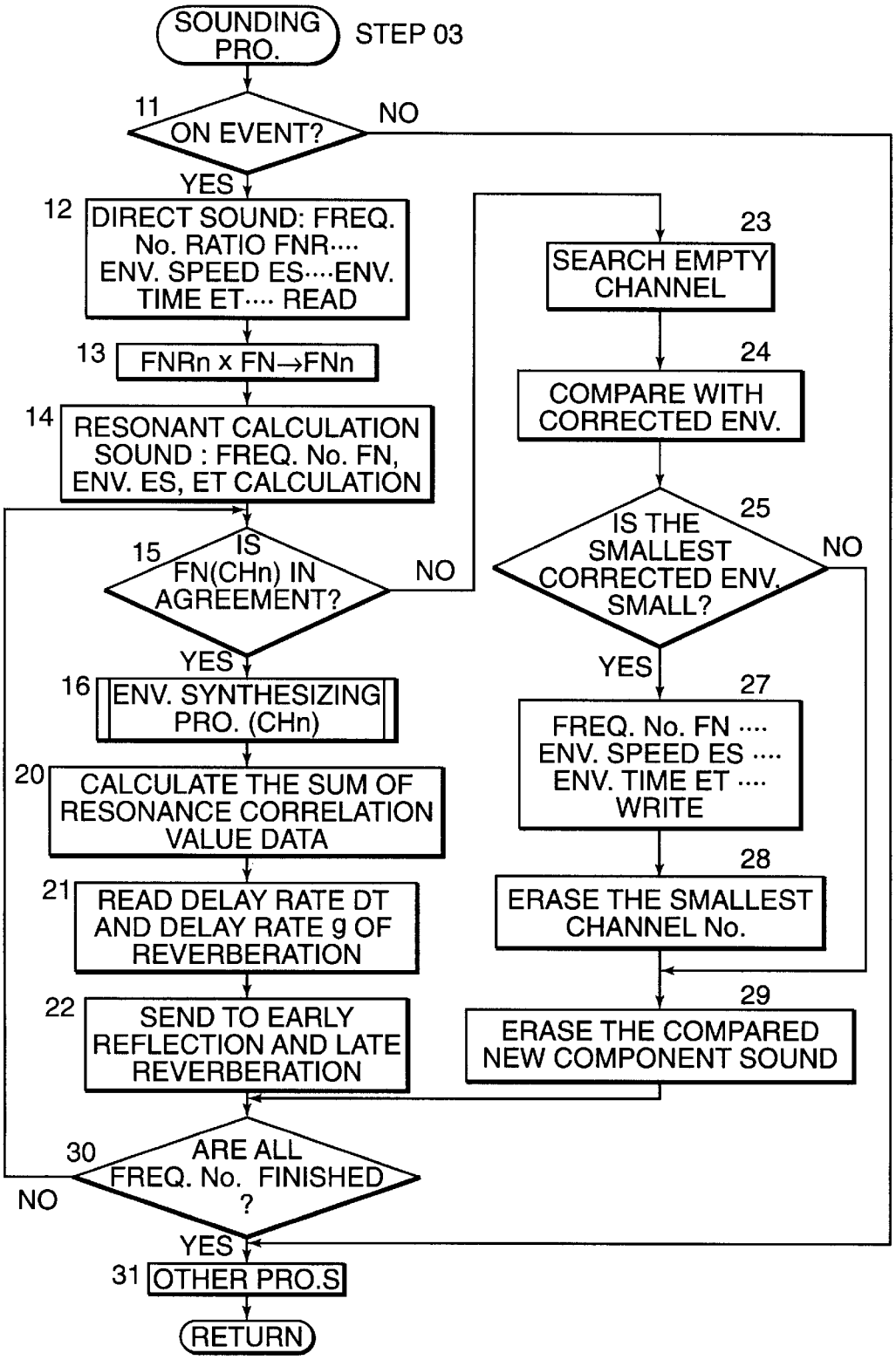
FIG. 16 is a flow chart illustrating the sounding start processing at a step 03.

FIG. 16 illustrates the sounding processing in accordance with the preferred embodiment. Referring initially to FIG. 16, the frequency number data FN of a component sound of a direct sound is determined (step 13), and the frequency number data FN of a resonance sound, envelope speed data ES and time data ET are found (step 14) If the component sound of the direct sound and the component sound of the resonance sound have the same frequency, they are synthesized into one and assigned to a single channel (steps 15 and 16). Resonance relation value data are determined from a table 35 of resonance relation values based on the whole key number data KN written into assignment memory 40, and the sum thereof is determined (step 20). The corresponding delay time data DT1, DT2, DT3, DT4, - - - DT51, DT52, DT53, DT54, - - - and decay rate data g1, g2, g3, g4, - - - , g51, g52, g53, g54, - - - are then read out from a reverberation table 31 (step 21), and are sent to a reflecting/reverberating circuit 90 (comprised of an early reflection sound-forming unit 60, late reverberation sound-forming unit 80) of a sound system 53 (step 22). Thus, the reverberation is changed and controlled based on the resonance characteristics (resonance degree) of musical tones that have been concurrently generated in the sound system 53.

2. Overall Circuitry

Figure 1:
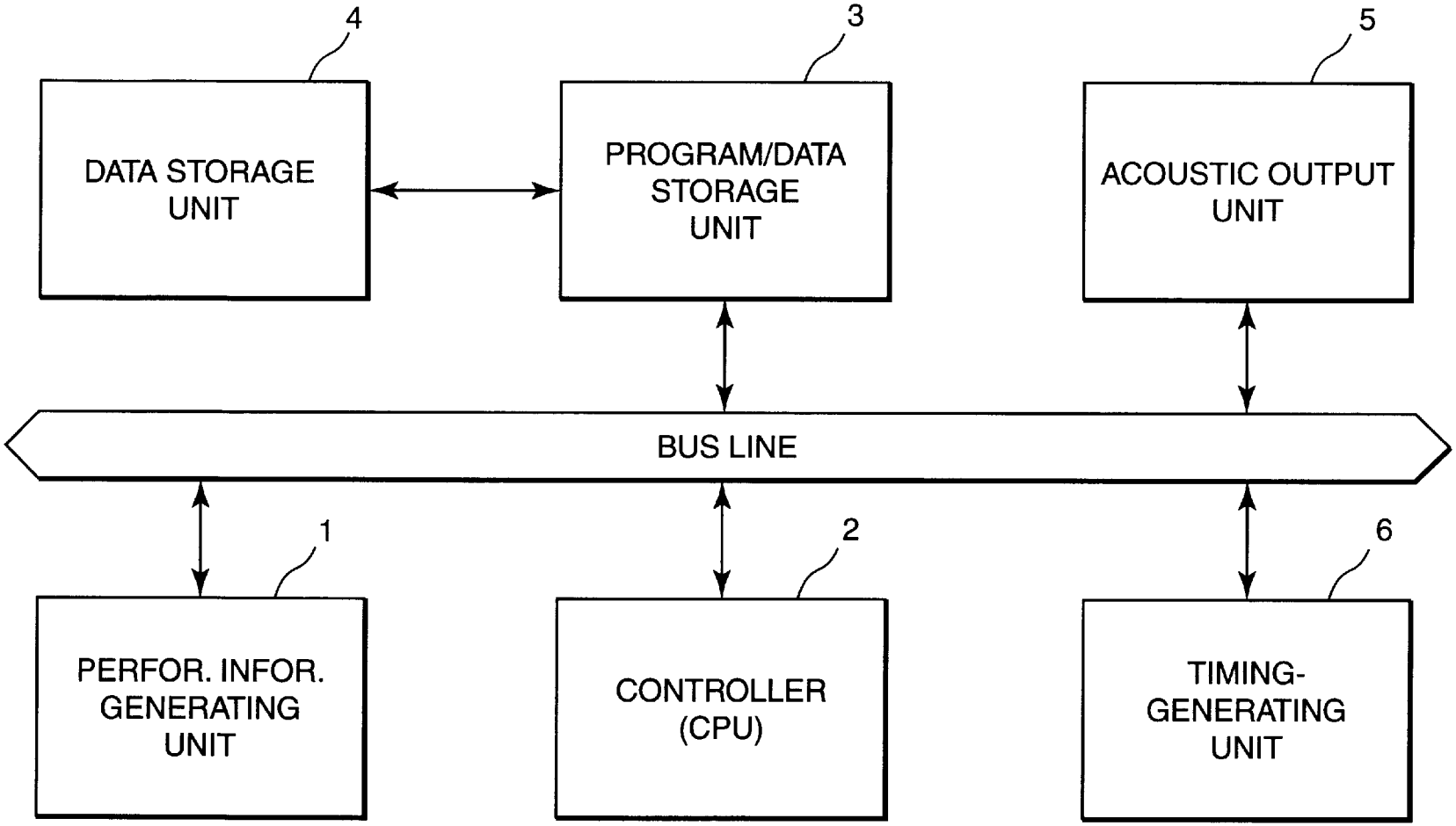
FIG. 1 illustrates the circuit of a reverberating/resonating apparatus in the present application.

FIG. 1 illustrates an overall circuitry of a reverberating/resonating apparatus, a tone-generating/controlling apparatus and/or an electronic musical instrument. A performance information-generating unit 1 generates performance information (tone-generating data). The performance information is for generating a tone. The performance information-generating unit 1 may be a sound instruction device played by manual operation, an automatic play device, a variety of switches, or an interface, for example.

The performance information includes musical factor data inclusive of tone pitch (tone pitch range data or tone-determining factor), sounding time data, field-of-performance information, number-of-sounds data and resonance degree data. The sounding time data represents the passage of time from the start of sounding a tone. The field-of-performance information represent part of play, part of tone, part of musical instrument, etc. This data corresponds to, for example, melody, accompaniment, background, chord, bass and rhythm, or to an upper keyboard, a lower keyboard or a foot keyboard.

The pitch data is accessed as key number data KN. The key number data KN includes octave data (tone pitch range data) and tone name data. The field-of-performance information is accessed as part number data PN. PN distinguishes the areas of play and are set depending upon the area of play of a tone that is sounded.

The sounding time data is accessed as tone time data TM, and are based upon time count data from a key-on event or substituted by envelope phase. The sounding time data has been disclosed in the specitication and drawings of Japanese Patent Application No. 219324/1994 as data related to the passage of time from the start of sounding.

The number-of-sounds data represent the number of tones that are concurrently sounded. For example, on/off data of an assignment memory 30 are based on the number of tone "1", which is found from flow charts of FIGS. 9 and 15 of Japanese Patent Application No. 242878/1994, FIGS. 8 and 18 of Japanese Patent application No. 276855/1994, FIGS. 9 and 20 of Japanese Patent Application No. 276857/1994, and FIGS. 9 and 21 of Japanese Patent Application No. 276858/1994.

The degree-of-resonance data represents the degree of resonance of a tone that is being sounded with other tones. When a frequency of pitch of one tone and a frequency of pitch of another tone establish small ratios of integers such as 1:2, 2:3, 3:4, 4:5, and 5:6, then, the value of the degree-of-resonance data increases. When the ratios of integers are as large as 9:8, 15:8, 15:16, 45:32 and 64:45, then, the value of the degree-of-resonance data decreases. The degree-of-resonance data is determined based upon the frequency number data FN, envelope speed data ES or envelope level data EL of the direct sound.

The sound instruction device can be a keyboard instrument, a stringed instrument, a wind instrument, a percussion instrument and a keyboard of a computer, for example. An automatic playing device automatically reproduces stored performance information. The interface is a MIDI (musical instrument digital interface) or the like, and receives performance information from, or sends performance information to, the device that is connected.

The performance information-generating unit 1 is equipped with various switches inclusive of timbre tablet, effect switch, rhythm switch, pedal, wheel, lever, dial, handle and touch switch, which are for musical instruments. Tone control data are generated by these switches. The tone control data can be musical factor data for controlling the tone that is generated, and includes timbre data (timbre-determining factor) touch data (speed/strength of sounding instruction operation), number-of-sounds data, degree-of-resonance data, effect data, rhythm data, sound image (stereo) data, quantize data, modulation data, tempo data, sound volume data and envelope data.

This musical factor data, too, is synthesized with the performance information (tone data) and input through a variety of switches, and are further synthesized with the automatic performance information or synthesized with the preformance information transmitted and received through the interface. A touch switch is provided for each of the sound instruction devices, and generates initial touch data representing the quickness and strength of touch as well as after touch data.

The timbre data corresponds to the kinds of musical instruments (sounding media/sounding means) such as a keyboard instrument (piano, etc.), a wind instrument (flute, etc.), a stringed instrument (violin, etc.) and a percussion instruments (drum, etc.), and is accessed as tone number data. The envelope data includes envelope time, envelope level, envelope speed and envelope phase.

Such musical factor data are sent to a controller 2 where a variety of signals (that will be described later), data and parameters are evaluated to determine the content of the tone. The performance information (tone-generating data) and tone control data are processed by the controller 2, a variety of data are sent to an acoustic output unit 5, and a tone signal is generated. The controller 2 includes a CPU, ROM and RAM.

A program/data storage unit 3 (internal storage medium/means) comprises a storage unit such as a ROM, a writable RAM, a flush memory or an EPROM. Additionally, this can also be a computer program that can be written and stored (installed/transferred) in a data storage unit 4 (external storage medium/means) such as an optical disk or a magnetic disk. In the program/data storage unit 3 are further stored (installed/transferred) programs transmitted from an external electronic musical instrument, or a computer through transmittal from a MIDI device or the transmitter/receiver. The program storage medium includes a communication medium.

An installation procedure (transfer/copy) is automatically executed when The data storage unit 3 is set into the tone-generating apparatus, or when the power source of the tone-generating apparatus is turned on, or when it is installed by an operator. The above-mentioned program corresponds to a flow chart that will be described later, with which the controller 2 executes a variety of processings.

The apparatus may store, in advance, another operating system, system program (OS) and other programs, and the above-mentioned program may be executed together with these OS and other programs. When it is installed in the apparatus (computer body) and is executed, the above-mentioned program executes the processings and functions described in the claims by itself or together with other programs.

Moreover, a part of or the entire program may be stored in, and executed by, one or more apparatuses other than the above-mentioned apparatus, and the data to be processed and the data/program that has been processed may be exchanged amongst the above-mentioned apparatus aid other apparatuses via communication means such as the Internet, for example in order to execute the processings in accordance with the present invention.

The program/data storage unit 3 stores the above-mentioned musical factor data, the above-mentioned variety of data and various other data. This variety of data includes data necessary for time-division processing as well as data to be assigned to time-division channels which will be discussed hereafter.

The acoustic output unit 5 generates tone signals in parallel that correspond to data written into the assignment memory 40, to produce sound. The acoustic output unit 5 concurrently generates a plurality of tone signals by the time-division processing to produce polyphonic sound. The acoustic output unit 5 also adds resonance and reverberation, and forms a sound image (stereo control).

The timing-generating unit 6 outputs timing control signals to each circuit so that the, whole circuitry of the reverberating/resonating apparatus, tone-generating/controlling apparatus and/or an electronic musical instrument is synchronized. The timing control signals include clock signals of all periods, as well as a signal of a logical product or a logical sur of these clock signals, a signal of a period of a channel-dividing time of the time-division processing, channel number data CHNo and time count data TI. The time count data TI represents the absolute time, i.e., the passage of the time. The period from a reset due to overflow of the time count data TI until a reset due to the next overflow is set so as to be longer than the longest sounding time among various tones. This period is set, depending upon the cases, to be several times as greater than the longest sounding time.

3. Component Sound Table 30

FIG. 2 shows a table 30 of component sounds in the program/data storage unit 3. Table 30 stores the data of component sounds constituting a tone of every timbre (tone number data TN), and the data of a corresponding component sound is transformed and read out from the tone number data TN. The data of the component sound include a plurality of frequency number ratio data FNR, a plurality of envelope data and such as envelope speed and time data (ES,ET). The component sound includes noise, which can be produced by the sound board of a keyed instrument (piano), by the pipe of a wind instrument and by the body of a stringed instrument, for example The frequency number ratio data FNR represents the ratios of frequencies of component sounds with respect to a basic frequency that varies depending upon the tone pitch. The frequency of a designated tone pitch is multiplied by the frequency number ratio data FNR to determine the frequency of each component sound. The frequency number ratio data FNR of the basic frequency is "1" and may be omitted.

The frequency number ratio data FNR is an integer, such as 2, 3, 4, 5, - - - , a number divided by an integer, such as 1/2, 1/3, 1/4, 1/5, - - - , a non-integer, such as 1.1, 1.2, 1.3, - - - , 2.1, 2.2, 2.3, - - - , or a number divided by a non-integer, such as 1/1.1, 1/1.2, 1/1.3, - - - , 1/2.1, 1/2.2, 1/2.3, The envelope data represents envelopes for each of the component sounds. The envelope data includes envelope speed data ES and envelope time data FT for each envelope phase. The envelope speed data ES represents a step value of operation per a period of digital operation of the envelope. The envelope time data ET represents the envelope operation time (generating time, sounding time) for each phase, i.e., the number of times of operation for each phase in the digital operation. The amplitude of the envelope waveform represents the amount of each component sound that is generated (each tone).

Each musical tone typically has a plurality of component sounds, but often it can have one component sound. The component sounds are synthesized and output for each musical tone. The radio of synthesis varies depending upon the envelope data. If the envelope operation level based on the envelope data is "0", the ratio of the component sound is "0". A channel is assigned to each of the component sounds and is separately controlled by the envelope. The channels are synthesized and output.

The level data LE represents the level for sustaining the envelope of each component sound. The level is a state where the envelope data is sustained. Therefore, the level data LE may be operated from the envelope speed data ES and the envelope time data ET, or may be omitted.

The level data LE may be a maximum level or an attack end level of the component sound in addition to the sustaining level. In this case, too, the level data LE may be operated from the, envelope, speed data ES and the envelope time data ET, or may be omitted. Moreover, the level data LE may be a value that varies depending upon the integrated value of the envelope waveform of the component ground. Thus, the level data LE varies depending upon the volume energy of the component sound.

4. Table 35 of Resonance Relation Values

FIG. 6 shows a table 35 of resonance relation values in the program/date storage unit 3. The resonance relation value data in table 35 represents the height of the resonance relationship between a tone of a given key number data KN and a tone of another key number data KN. For example, a key number C2 has a relationship as a second harmonic with respect to a key number C1. Therefore, the resonance relation data is as high as "0.8". A key number D2 has a relationship as a whole tone for the key number C1 and, hence, the resonance relation value data is as low as "0.1".

The resonance relation value data is high when it has a frequency ratio relationship of 1:n (n=1, 2, 3, 4, 5, 6, - - - ), and becomes even higher when it has frequency ratio relationships of 2:3 n (n=1, 2, 3, - - - ) (perfect fifth, etc. ), 3:4 n (n=1, 2, 3, - - - ) (perfect fourth, etc.), 3:5 n (n=1, 2, 3, - - - ) (major sixth, etc.) 4:5 n (n=1, 2, 3, - - - ) (major third), and 5:6 n (n=1, 2, 3, - - - ) (minor third). In the above-mentioned frequency ratio relationship 1:n (n=1, 2, 3, 4, 5, 6 - - - ), the resonance relation value data decreases with an increase in the value "n".

Resonance relation value data among concurrently generated tones is determined using table 35 and are added up together (synthesized). The delay rate or the decay rate of reverberation characteristics is changed based upon the thus calculated resonance relation data.

The key number data KN of the concurrently generated tones is read out from an assignment memory 40 that will be described below. The tones of the key number data KN are written in the assignment memory 40 and are sounded, and have on/off data "1". There may also, of course, be tones having on/off data "0".

5. Assignment Memory 40

Figure 3:
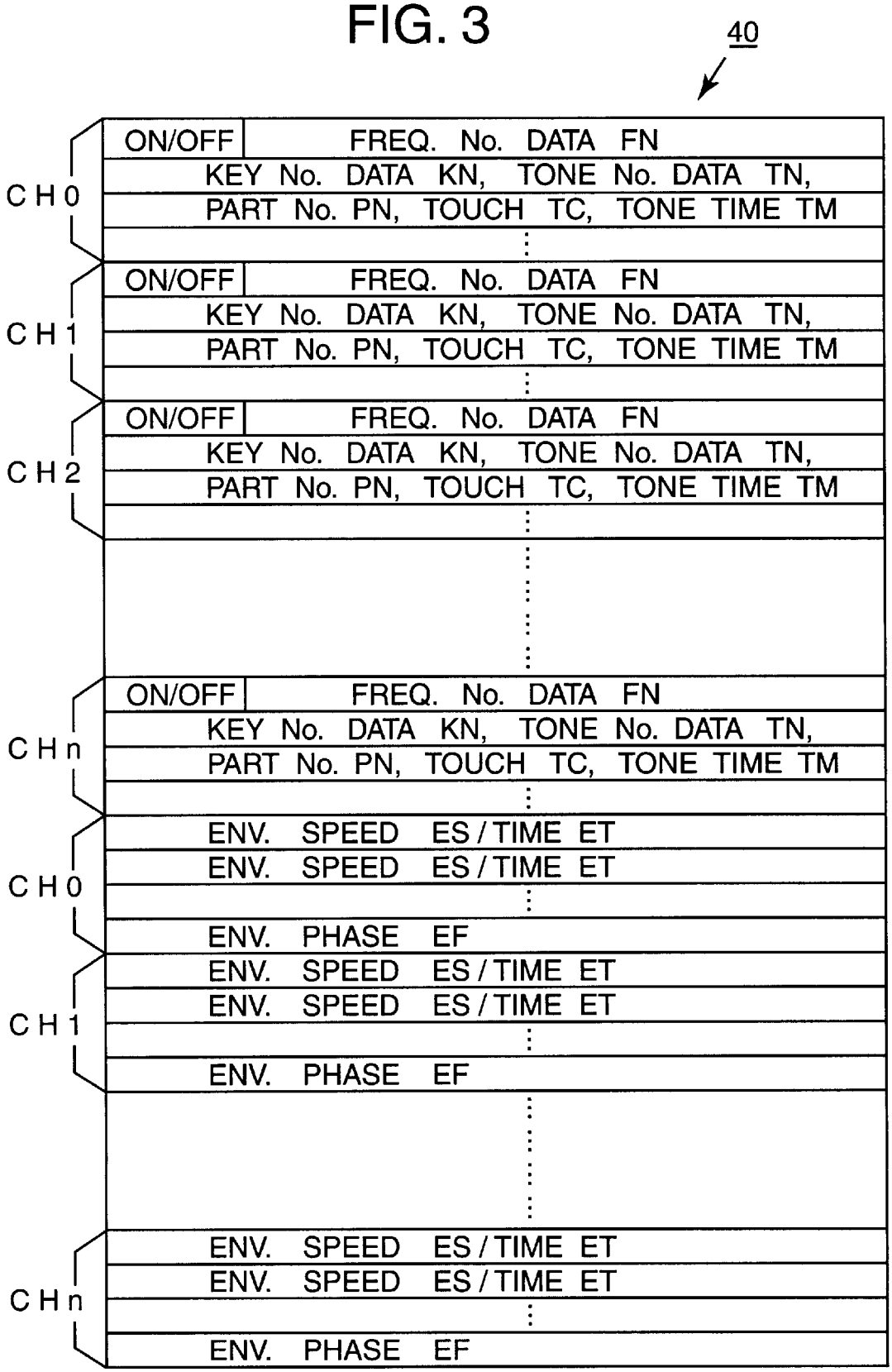
FIG. 3 illustrates an assignment memory 40 in an acoustic output unit 5.

FIG. 3 illustrates an assignment memory 40 in the acoustic output unit 5. A plurality of channel memory areas (of a number of 16, 32, 64, 128, etc.) are in assignment memory 40 to store data related to component sounds assigned to a plurality of tone-generating channels that are formed in the acoustic output unit 5.

Frequency number data FN of component sounds to which the channels are assigned, key number data KN, envelope speed data ES, envelope time data ET and envelope phase data EF are stored in the channel memory areas. There are additionally stored tone number data TN, touch data TC, tone time data TM, part number data PN, resonance degree data and on/off data.

In the channel memory areas are further stored frequency number data FN of resonance sound and noise to which the channels are assigned, key number data KN, as well as envelope speed data ES, envelope time data ET and envelope phase data EF of the resonance sound in addition to the component sound (direct sound).

A simple relationship of a ratio of integer times exists between a value of the frequency number data FN of resonance sound and a value of the frequency number data FN of direct sound. For example there exists a relationship of frequency ratios of 1:n (n=1, 2, 3, 4, 5, 6, - - - ), 2:n (n=3, 5, 7, 9, 11, 13, - - - ), 3:n (n=4, 5, 7, 8, 10, 11, - - - ), 4:n (n=5, 7, 9, 11, 13, 14, - - - ) 5:n (n=6, 7, 8, 9, 11, 12, - - - ).

Among them, 1:2 (octave), 2:3 (perfect fifth), 3:4 (perfect fourth), 4:5 (major third), 5:6 (minor third) are particularly selected. Therefore, the value of the frequency number data FN of resonance sound is the one obtained by proportionally reckoning the value of the frequency number data FN of direct sound by the ratio of an integer times, e.g., 2 times, 3/2 times, 4/3 times, 5/4 times, - - - , 3 times, 4 times, 5 times, - - - .

The proportionally reckoned frequency number data FN of the resonance sound can be replaced by a key number data KN of the closest pitch. However, there exists a slight deviation between a value of the frequency number data FN corresponding to the key number data KN of the closest pitch and a value of the frequency number data FN of the proportionally reckoned resonance sound due to S-curve tuning. In order to realize a ratio of a perfect integer times, therefore, there is used the proportionally reckoned frequency number data FN. Otherwise, a key number data KN of a pitch close to the proportionally reckoned value is used.

Furthermore, the envelope speed data ES, or with respect to the envelope level data EL of the resonance sound, too, is proportionally reckoned based on the ratio of integer times of the frequency number data FN with respect to the envelope speed data FS or the envelope level data EL of the direct sound, i.e., multiplied by 1/2 times, 2/3 times, 3/4 times, 4/5 times, - - - , 1/3 times, 1/4 times, 1/5 times, - - - . The resonance sound value has been determined to be two, three, four, five, - - - with respect to one direct sound. Therefore, resonance sound may not be formed it they have proportionally reckoned values smaller than a predetermined value.

Thus, the resonance sound has the same tone data TN and the same tone waveform with respect to the direct sound, and the amplitude of envelope decreases depending upon the proportional reckoning. When harmonics of a sine wave are, synthesized for the generated tone, the number of synthesized sine waves of the direct sound becomes smaller than the number of synthesized sine waves of the resonance sound, and synthesized sounds having higher frequencies are cut. The number of the synthesized sine waves of the direct sound may also be equal to the number of the synthesized sine waves of the resonance sound, as a matter of course.

When the component sound of direct sound and the component sound of resonance sound have the same frequency, they are synthesized together, assigned to one channel, and written into one channel area of assignment memory 40. In this synthesis, the waveform of each envelope is synthesized into an envelope waveform, and an envelope speed data ES and an envelope time data ET are selected for generating the synthesized envelope waveform.

Here, if the envelope waveform of the component sound of direct sound is the same as the envelope waveform of the component sound the resonance sound, of the envelope time data ET for both is equated. Therefore, the envelope time data ET of either the component sound of direct sound or the component sound of resonance sound can be selected, and the envelope speed data ES of the component sound of direct sound and the envelope speed data ES of the component sound of resonance sound are added up and synthesized together.

The value of the frequency number data FN for noise is the same as the value of the frequency number data FN for direct sound, and remains constant irrespective of the pitch of the direct sound. However, the noise has a tone data TN and a tone waveform different from that of the direct sound, and has an envelope amplitude that may be smaller than, or equal to, that of the direct sound. The noise has the characteristics of resonance sound as that of the direct sound and thus has the same frequency. However the value of the frequency number data FN for the noise may be calculated from the value of the frequency number data FN of the direct sound.

The on/off data represents whether a tone (component sound) that is assigned and sounded is being keyed on or sounded ("1") or is being keyed off or sounded off ("0"). The frequency number data FN represents the frequency value of the component sound that is assigned and sounded and is converted from the key number data KN, and is multiplied by the frequency number ratio data FNR. The program/data storage unit 3 is provided with a table (decoder) for the conversion.

The envelope speed data ES and the envelope time data ET are as described above. The envelope speed data ES and the envelope time data ET are rewritten every time a new component sound of the same frequency is assigned to the channel, and are replaced by the envelope speed data ES and envelope time data ET resulting from the envelope obtained by synthesizing the new component sound.

Figure 5:
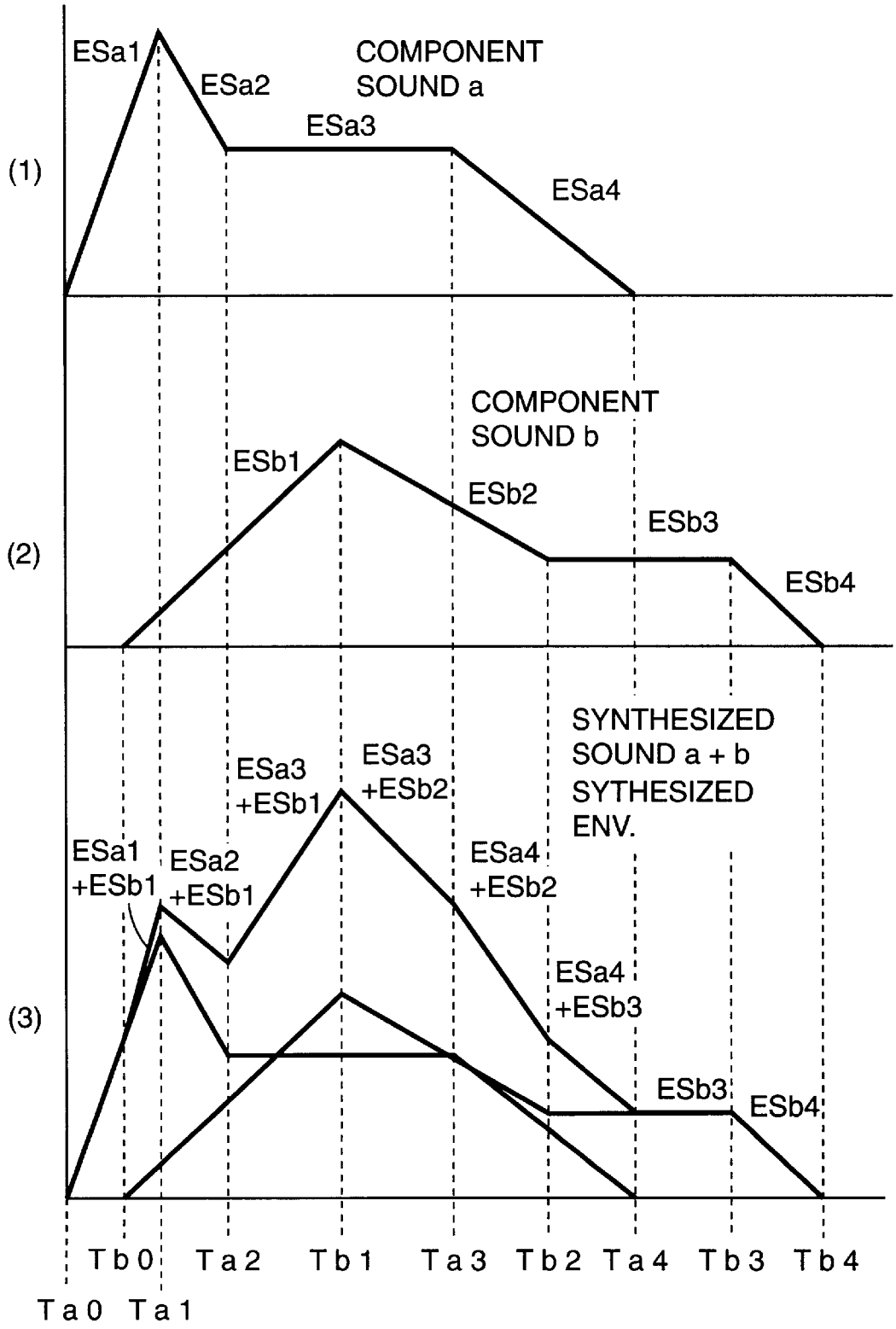
FIG. 5 shows the waveform of a synthesized envelope of a component sound (a) and a component sound (b) of the same frequency.

The envelope phase data EF represent portions of the envelopes of FIGS. 5(1), 5(2) and 5(3) before and after being synthesized. A value counted by a phase counter 501 is accessed and stored as the envelope phase data EF in the assignment memory 40.

The key number data KN represents the pitch (frequency) of a tone that is assigned and sounded, as determined by the tone pitch data. The key number data KN is stored for all component sounds that constitute a musical tone, for example, and is added and stored in a corresponding channel memory area in the assignment memory 40 every time a component sound is assigned to the channel and is synthesized due to an on event, and is erased for every "off" event. The high-order data of the key number data KN represents the tone pitch range or octave, and the low-order data represents the tone name.

In response to the key number data KN, envelope speed data ES and envelope time data ET of release for the envelope of the component sound are stored. If each component sound has a plurality of envelope speed data ES and a plurality of envelope time data ET of release, they are all stored.

The tone number data TN represents the timbre of a tone that is assigned and sounded, and is determined based on the timbre data. If the tone number data TN differs, the timbre of t-he tone differs and the waveform of the tone differs, too. The touch data TC represents the quickness or strength of the sounding operation, is selected by operating the step switch, and is determined based on the touch data. The part number data PN represents the play area as described above, and is set based on which play area the sounded tone belongs to. The tone time data TM represents the passage of time from the key-on event.

The data in these channel memory areas are written at "on" timings and/or at "off" timings, rewritten and read out for every channel timing, and processed by acoustic output unit 5. The assignment memory 40 may alternatively be provided in the program/data storage unit 3 or in the controller 2, instead of in the acoustic output unit 5.

The method of assigning or truncating the tones to the channels formed by the time-division processing, (i.e., to a plurality of tone-generating systems for generating a plurality of tones (component sounds) in parallel), may be similar to that disclosed in, for example, Japanese Patent Application No. 42298/1989, 305818/1989, 312175/1989, 208917/1990, 409577/1990 or 409578/1990.

6. Acoustic Output Unit 5

Figure 4:
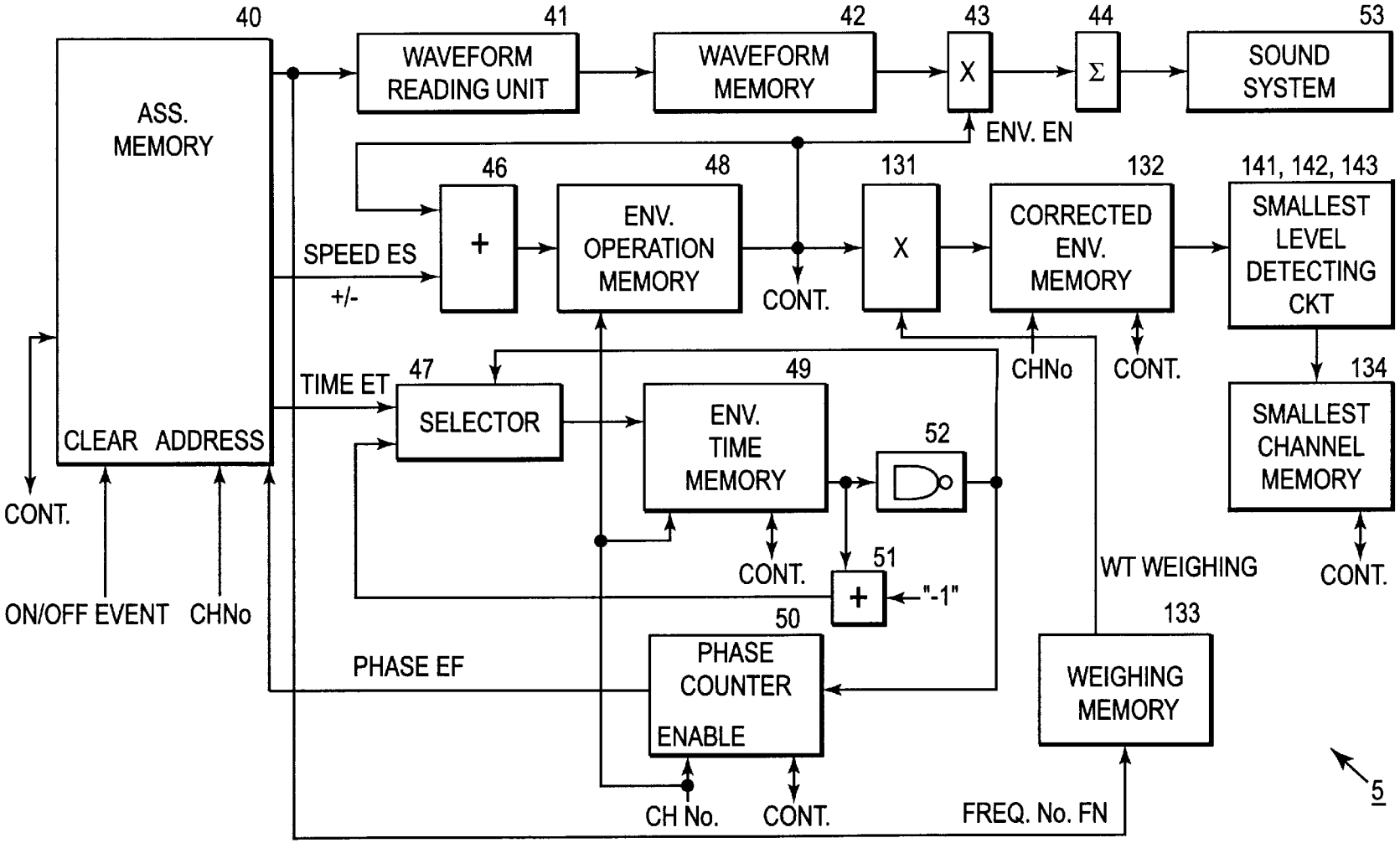
FIG. 4 illustrates the acoustic output unit 5.

FIG. 4 illustrates the acoustic output unit 5. The frequency number data FN of the channels of the assignment memory 40 are sent to a waveform reading unit 41 where the tone waveform data MW are read out at a speed (tune pitch) corresponding to the frequency number data FN. The tone waveform data MW that is read out is stored in a waveform memory 42, and then multiplied and synthesized by the envelope data EN through a multiplier 43, added up and synthesized with the tone waveform data of all channels through an accumulator 44, and is sounded through a sound system 53.

The tone waveform data MW exists, as a sine wave. Therefore, a plurality of sine waves of dissimilar frequencies are synthesized together and are output as harmonics for each tone. Therefore, if the amplitude or frequency of each sine wave undergoes a change, the waveform of the synthesized tone changes and the timbre changes, too. The sine wave is not stored in the waveform memory 42, but may be convert from the tone time data TM or the time count data TI via a trigonometric function.

The tone waveform data MW may often have a complex waveform in addition to the sine wave, and includes the tone waveform data MW of the resonance sound and tone waveform data MW of noise. The waterfront that differs in regard to the timbre, part, tone pitch (tone pitch range), touch and sounding time, is stored and selected. In this case, the tone number data TN, part number data PN and touch data TC are sent to the waveform reading unit 41, and the tone waveform data MW corresponding to the tone number data TN, part number data PN or touch data TC is selected from the waveform memory 42, and the selected tone waveform data MW is read out at a speed (tone pitch) corresponding to the frequency number data FN.

The envelope speed data ES of the channels in the assignment memory 40 are time-divisionally and successively accumulated through an adder 46 and an envelope operation memory 48 where the envelope operation data FN is processed and is sent to the multiplier 43 as the envelope data EN. The envelope operation memory 48, which has areas corresponding to the number of the time-divisional channels, stores the envelope operation data EN of the channels, and processes the envelopes for each of the channels.

The envelope operation memory 48 is specified for its address by the channel number data CHNo, and the specified address is written/read out or reset. The channel areas of the envelope operation memory 48 are separately reset (cleared) depending upon the "off" event signals and/or the "on" event signals.

The envelope time data ET of the channels of the assignment memory 40 are successively decreased by "−1" through a selector 47, envelope time memory 49 and adder 51. When they become "0", a phase end signal is detected by a group of NAND gates 52 and is output. The phase end signal represents the end of phases of the envelope.

The phase end signal is input to the phase counter 50 and is increased by +1. The phase counter 50 counts the phases of the envelope of each channel. The phase Counter 50 is provided with a number of counters corresponding to the number of time-divisional channels, and the counter specified by the channel number data CHNo can be either increased or reset.

In the phase counter 50, the counter specified by the channel number data CHNo only is reset (cleared) by the controller 2 at the on event and off event. At this moment, as described above, the envelope speed data ES and the envelope time data ET are synthesized/rewritten.

The envelope phase data EF of the phase counter 50 is sent as an address to the assignment memory 40, and the envelope speed data ES and the envelope time data ET are read out or written for each phase in the channels. The assignment memory 40 is specified for its address by the channel number data CHNo, and the specified address is written/read out or cleared. The channel areas of the assignment memory 40 are separately reset (cleared) by the off event signals and/or the on event signals.

The phase end signal is sent to the selector 47 for envelope time data ET of a next or following phase. The envelope time memory 49 is specified for its address by the channel number data CHNo, and the specified address written/read out or is reset. The channel areas of the envelope time memory 49 are separately reset (cleared) by the off event signals (on event signals).

The envelope operation data EN of the channels from the envelope operation memory 48 are weighed through the multiplier 131 for assigning the channels, and are written into a corrected envelope memory 132. The corrected envelope memory 132 has areas corresponding to the number of the time-divisional channels and stores the corrected envelope data MEN of the channels.

The weighed and corrected envelope data MEN are compared through a first minimum level detecting circuit 141, a second minimum level detecting circuit 142 and a third minimum level detecting circuit 143, and the channel numbers having the smallest level, second smallest level and third smallest level are detected from each channel. The detected smallest channel number 1MCH, second smallest channel number 2MCH and third smallest channel number 3MCH are stored in a smallest channel memory 134. The smallest channel numbers 1MCH, 2MCH and 3MCH represent the order of priority for replacing (truncating) the channels.

The first smallest level detecting circuit 141, second smallest level detecting circuit 142 and third smallest level detecting circuit 143 also detect the channel of which the corrected envelope data MEN is "0", and the thus detected data is stored as an empty channel flag ECF in the smallest channel memory 134 together with the channel numbers 1MCH, 2MCH and 3MCH. The first smallest level detecting circuit 141, second smallest level detecting circuit 142 and third smallest level detecting circuit 143 are shown in more detail in FIG. 13 of Japanese Patent Application No. 16617/1998.

The first smallest level detecting circuit 141, second smallest level detecting circuit 142 and third smallest level detecting circuit 143 also detect the corrected envelope data MEN of the detected channels, and the thus detected three smallest corrected envelope data 1MEN, 2MEN and 3MEN are also stored in the smallest channel memory 134. The data are written into the smallest channel memory 134 and into the corrected envelope memory 132 in one half of a time-division channel time and are read out therefrom in the other half.

The frequency number data FN of the channels read out from the assignment memory 40 are sent to a weighing memory 133, from where the weighing data WT is read out and sent to the multiplier 131 to weigh the order of priority for replacing (truncating) the channels. In Weighing data WT that corresponds to the frequency number data FN as is stored in weighing memory 133. The content of the weighting data is shown in FIG. 14(2).

According to the characteristics curve (2), weighing increases near the intermediate tone of tone frequencies (from 1000 Hz to 4000 Hz), and decreases in the low-pitched tones and in the high-pitched tones. The characteristics curve (2) is analogous to a loudness curve or a lower curve (area) of hearing for a person, and makes it possible to realize priority characteristics for assigning channels that match the human hearing senses (loudness characteristics, masking characteristics). This is achieved only where component sounds of the same frequency are synthesized together, to which a channel is assigned.

The lower curve (area) of hearing represents characteristics corresponds to a frequency (tone pitch) of a minimum sound intensity (i.e., decibel level of the threshold of audibility) that can be heard by a human, and the loudness curve represents characteristics corresponding to frequencies of t:he sound intensity that can be heard by a human to be of the same intensity. The characteristics curve of FIG. 14(2) is one in which the loudness curve or the lower curve (area) of hearing of a man is reversed. Therefore values of a middle tone pitch range are large and values of a high tone pitch range and a low tone pitch range are small.

Figure 14:
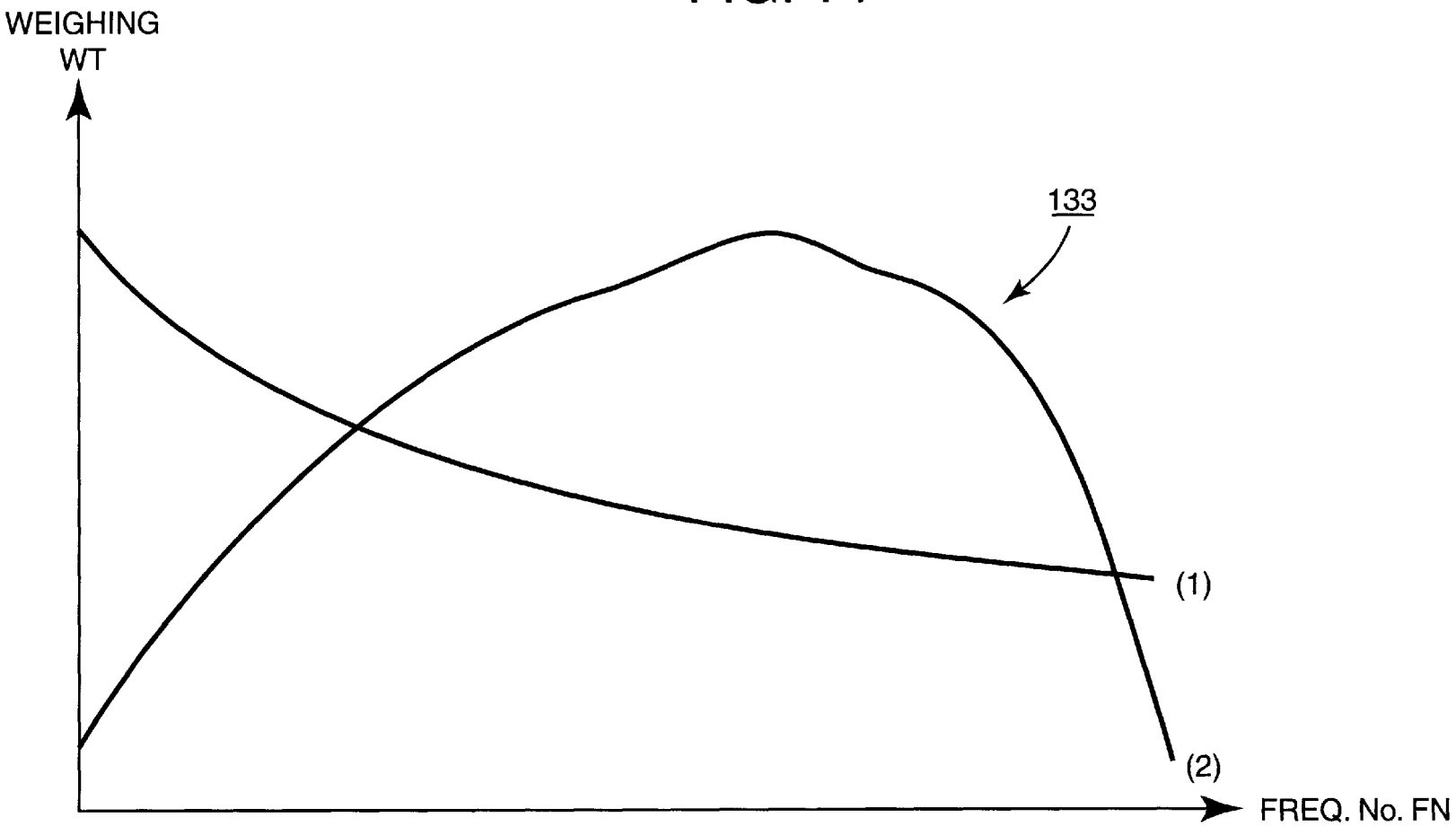
FIG. 14 illustrates the content of weighing data WT stored in a weighing memory 133.

As represented by FIG. 14(1), furthermore, the weighting data WT increases with a decrease in the frequency of the tone, and the priority for assigning the channels may increase toward low-pitched tones. Conversely the weighing data WT may be such that the probability of replacing the channels increases toward low-pitched tones. Moreover, the weighing memory 133 and the multiplier 131 may be omitted, and the priority for assigning the channels may not be weighed based on the musical properties. Therefore, the probability for replacing or truncating the channels increases with a decrease in the level of the synthesized component sound of each channel.

It is alternatively desirable to input other musical factor data to the weighing memory 133, instead. The musical factor data can include, for example, the above-mentioned key number data KN, tone number data TN, part number data PN, touch data TC, tone time data TM, resonance relation value data, etc. Therefore, the priority for assigning the channels can be determined in accordance with musical properties such as tone pitch range (tone pitch), timbre, field of play, touch sounding time and degree of resonance, for example.

Therefore, the priority for assigning the channels increases and the truncating decreases with an increase in the tone (timbre) number, touch data or degree of resonance, or with a decrease in the tone pitch (tone pitch range), part number (MIDI channel number) or sounding time. A plurality of these types data added up together and may be sent to the weighing memory 133.

The number of acoustic output units 5 provided depends on the number of the stereo channels (audio channels) used for forming the sound image. Sound image data is stored in the channel areas of the assignment memories 40 of the stereo (audio) channels, and are multiplied and synthesized by the tone waveform data or envelope data EN of the channels through the multiplier 43, to thereby form a sound image. A system for assigning the channels in the stereo (audio) channel system or described above has been taught in the specification and drawings of Japanese Patent Applications Nos. 204404/1991 and 408859/1990.

7. Early Reflection Sound and Late Reverberation Sound

Figure 7A:
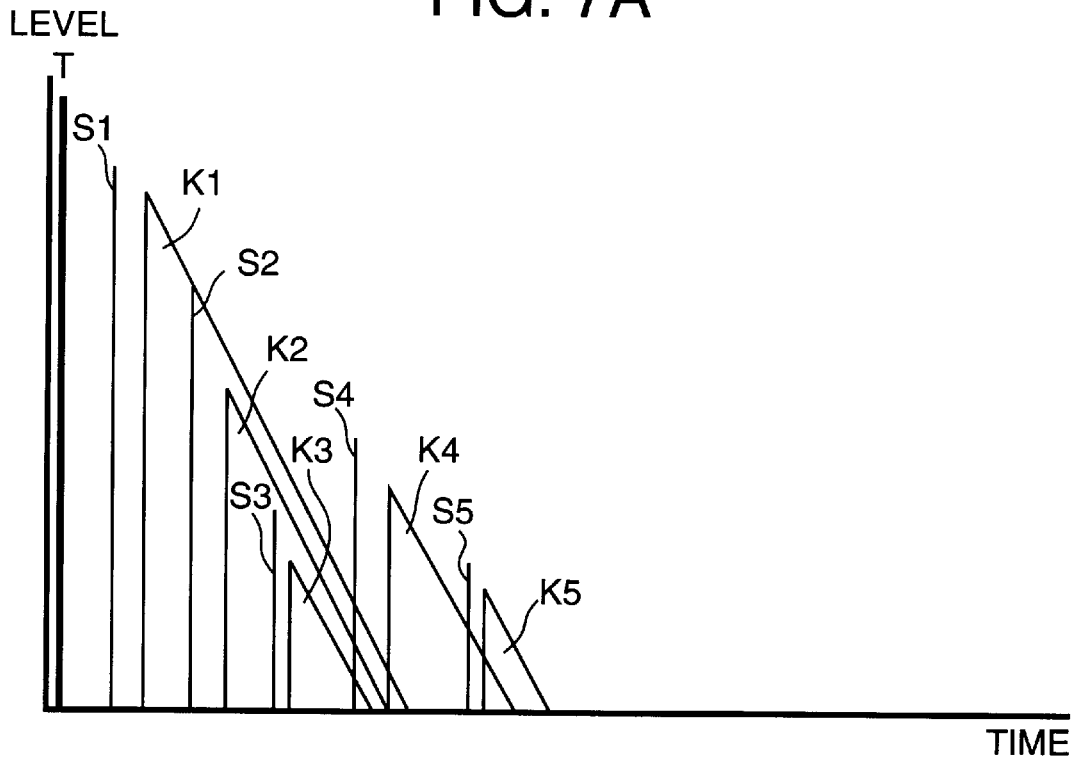
FIGS. 7A and 7B show direct sound, early reflection sound and late reverberation sound.
Figure 7B:
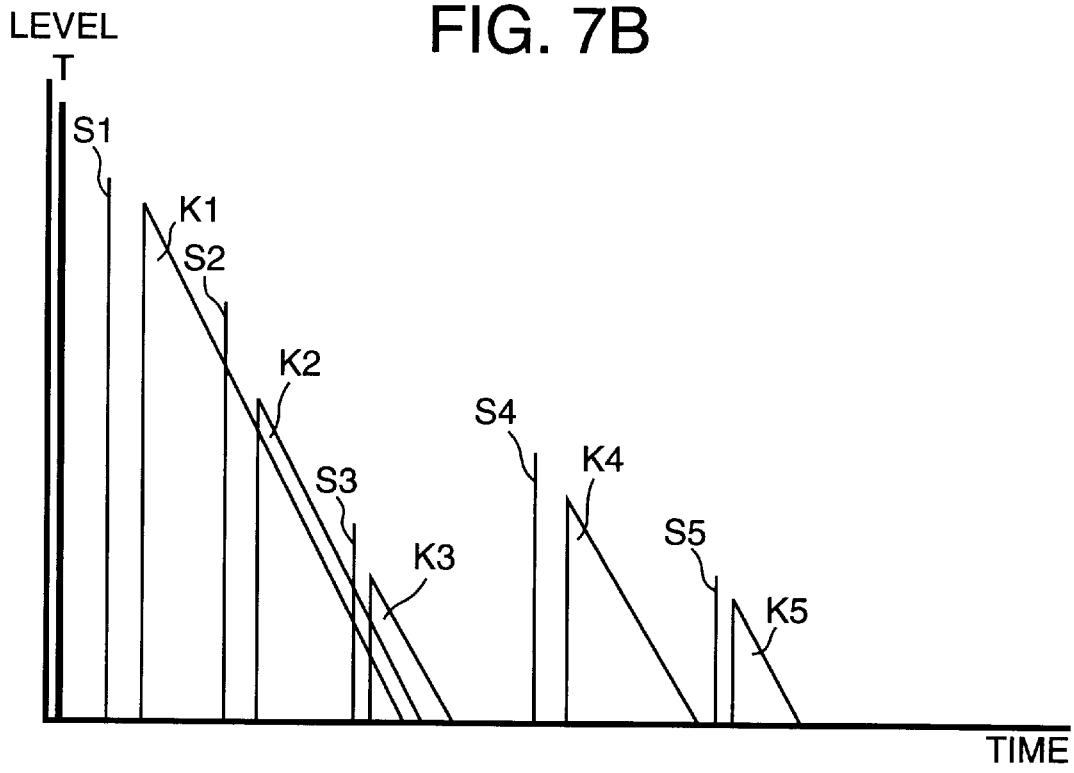

The waveform data of the right and left sound sources generated from the acoustic output unit 5 is the direct sound data T. Direct sound data T is tone waveform data representing a tone that corresponds to a direct sound in the natural or background sound. As shown in FIGS. 7A and 7B, a plurality of early reflection sound data S1, S2, S3, S4, S5, - - - is generated from the direct sound data T. Then, late reverberation sound group data K1, K2, K3, K4, K5, - - - is generated from the preceding early reflection sound data S1, S2, S3, S4, S5, - - - .

The direct sound data T is represented by a line in FIGS. 7A and 7B. In practice, however, the tone waveform is synthesized with an envelope waveform, and has a time width of attack → decay → sustain → a release. Therefore, every sound has a similar time width in the early reflection sound data S1, S2, S3, S4, S5, - - - and in the late reverberation sound group data K1, K2, K3, K4, K5, - - - .

8. Reverberation Table 31

FIG. 8 illustrates a reverberation table 31 in the program/data storage unit 3. In the reverberation table 31 are stored time delay data DT1, DT2, DT4, - - - , DT51, DTS2, DT53, DT54, - - - , and decay rate data g1, g2, g3, g4, - - - , g51, g52, g53, g54, - - - . This data is stored in the form of many layers being grouped into the whole data or high-order data of the resonance relation value data, and into the musical factors, i.e., being grouped into tone, pitches, timbres, touches, sounding times, envelope levels, envelope speeds, envelope times and envelope phases.

The resonance relation value data change based on a change in the relationships among the tone pitches of the concurrently sounded tones, as a result of a change in the concurrently sounded tones. Then, the delay time data DT1, DT2, DT3, DT4, - - - , DT51, DT52, DT53, DT54, - - - and a delay rate data g1, g2, g3, g4, - - - , g51, g52, g53, g54, - - - undergo a change, and the delay rate or the decay rate of the reverberation characteristics is changed.

The sound image data (stereo factor) determines the sound image position, and sets, for example, the levels of the tones of the channels and the phases of the tones of the channels, so as to set the position (direction) and size of the sound image relying upon the data.

The delay time data DT1 determines the delay times of the preceding early reflection sounds SA, SB, SC, the delay time data DT2 determines the delay times of the succeeding early reflection sound groups Sa, Sb, Sc, and the delay time data DT3 and DT4 determine the delay times of the late reverberation sound trains SSA, SSB. The decay rate data g1 represents the decay rate of the preceding early reflection sounds SA, SB, SC, the decay rate data g2 represents the decay rate of the succeeding early reflection sounds Sa, Sb, Sc, and the decay rate data g3 represents the decay rate of the late reverberation sound trains SSA, SSB.

The decay rate data g1 represents the decay rate of the preceding early reflection sound SA, the decay rate data g2 represents the decay rate of the preceding early reflection sound SB, and the decay rate data g3 represents the decay rate of the preceding early reflection sound SC. The decay rate data g4 represents the decay rate of the succeeding early reflection sound SA, the decay rate data g5 represents the decay rate of the succeeding early reflection sound Sb, and the decay rate data g6 represents the decay rate of the succeeding early reflection sound Sc. Here, $0<g1, g2, g3, g4, g5, g6, - - - <1$ holds. The decay rate may be a rate of change of the output level relative to the input level. Some of the values of the delay time data DT1, DT2, DT3, - - - , g1, g2, g3, - - - may be the same, or all of them may be different.

9. Sound System 53

Figure 9:
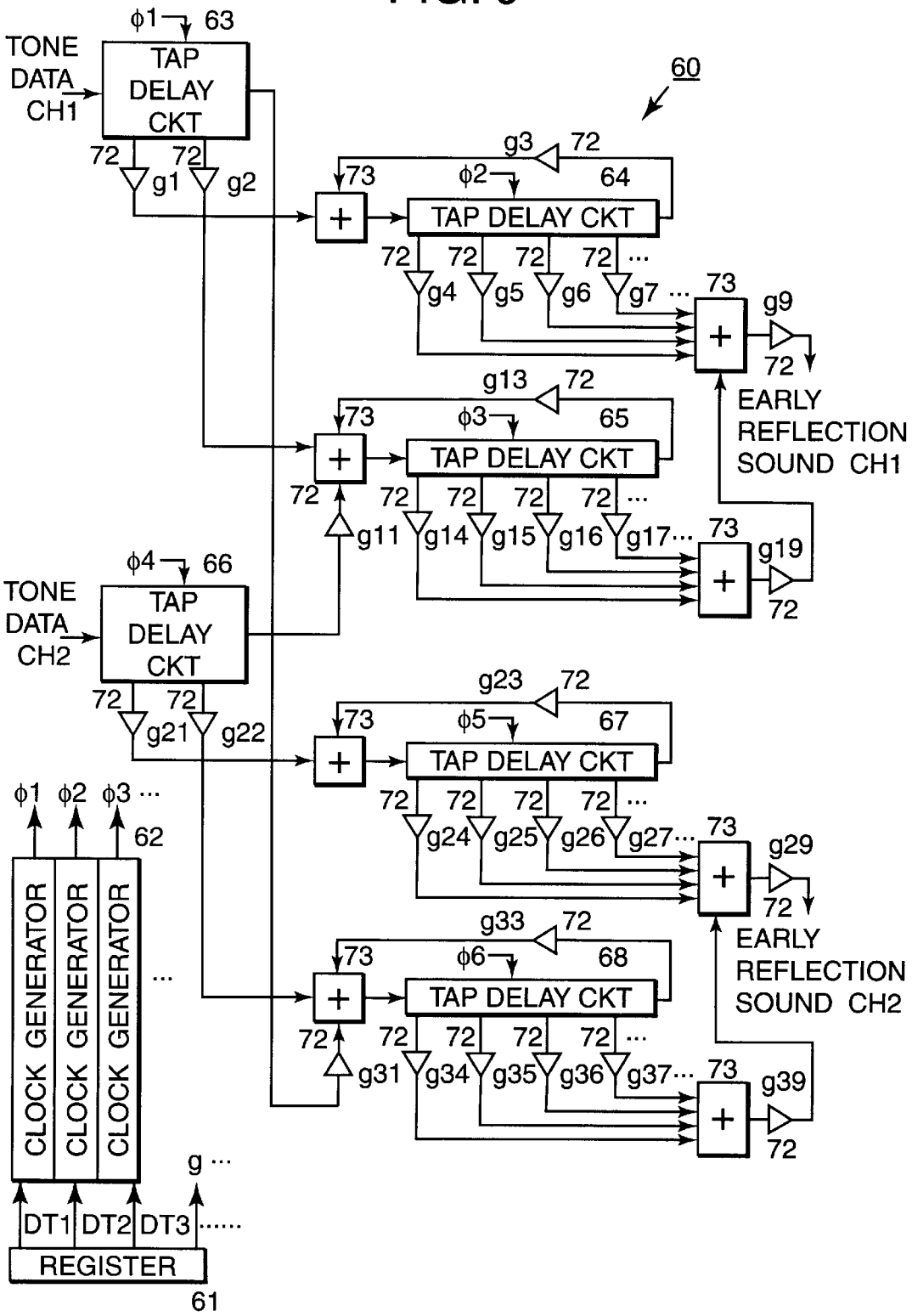
FIG. 9 shows an early reflection sound-forming unit 60 in a sound system 53.

FIG. 9 illustrates an early reflection sound-forming unit 60 in the sound system 53. The delay time data DT1, DT2, DT3, - - - are stored in a register 61 and are fed to clock generators 62, 62, 62, - - - . The clock generators 62, - - - are programmable and generate clock signals ϕ1, ϕ2, ϕ03, - - - 06 having frequencies that correspond to the delay time data DT1, DT2, DT3, - - - and which are fed to respective tap delay circuits 63, 64, 64, 65, 66, 67 and 68.

The tap delay circuits 63, 64, 65, 66, 67 and 68 comprise CCDs (charge-coupled devices), and successively receive tone data input at speeds corresponding to the frequencies of the applied clock signals ϕ1, ϕ2, ϕ03, - - - 06, so that the input one data are output from the taps in a delayed manner. Therefore, the delay time data DT1, DT2, DT3, - - - determining the delay time or delay rate in the reverberation sound (early reflection sound) or in the reverberation characteristics. The right and left stereo sound are input through the two input terminals of the early reflection sound-forming unit 60.

The decay rate data g1, g2, g3, - - - are stored in a register 61 and are fed to a plurality of multipliers 72. The multipliers 72 multiply the input tone data by the decay rate data g1, g2, g3, - - - so as to be decayed by small amounts. Therefore, the decay rate data g1, g2, g3, - - - determine the magnitude of decay, amount of decay or decay rate in the reverberation sound (early reflection sound) or in the reverberation characteristics.

The outputs of the tap decay circuits 63, 64, 65, 66, 67, 68 and of the multipliers 72 are added up and synthesized by adders 73, and are fed back to the tap delay circuits 63, 64, 65, 66, 67 and 68.

Therefore, the generated early reflection sound (reverberation sound) becomes very complex, multiplexed and very broad.

Figure 10:
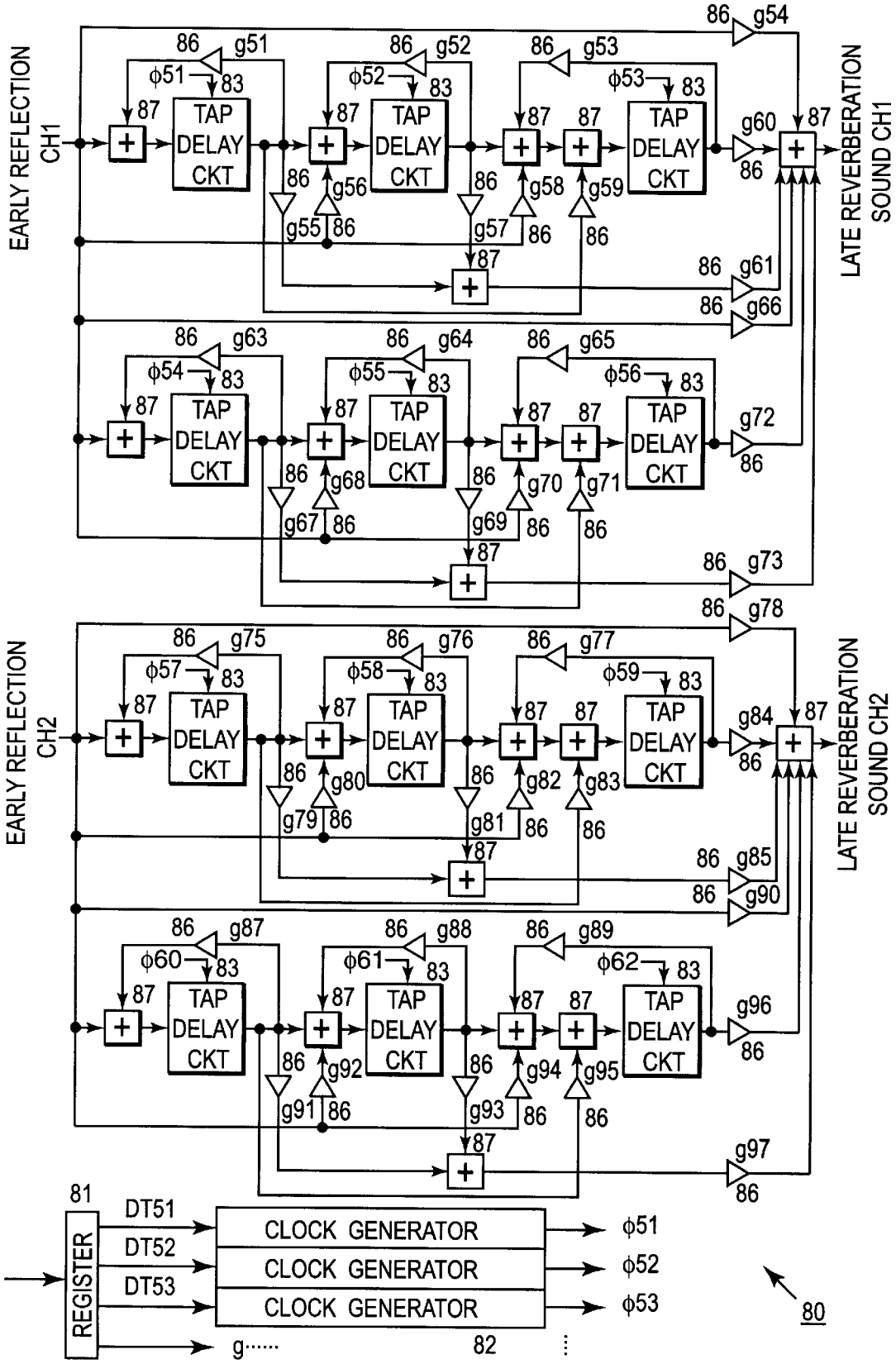
FIG. 10 shows a late reverberation sound-forming unit 80 in the sound system 53.

FIG. 10 illustrates a late reverberation sound-forming unit 80. Tone data output from the early reflection sound-forming unit 60 are input to the late reverberation sound-forming unit 80. The delay time data DT51, DT52, DT53, - - - are stored in a register 81 and arc fed to clock generators 82, 82, 82, - - - . The clock generators 82 are programmable, and generate clock signals ϕ51, ϕ52, ϕ53, - - - of frequencies depending upon the input delay time data DT5, DT52, DT53, - - - arid these clock signals are in turn input to tap delay circuits 83, 83, - - - .

The tap delay circuits 83, which - - - comprise CCDs (charge-coupled devices), successively receive tone data input at speeds corresponding to the frequencies of the applied clock signals ϕ51, ϕ52, ϕ53, - - - , and output the input tone data from the taps in a delayed manner. Therefore, the delay time data DT51, DT52, DT53, - - - determines the delay timings, and the delay time or delay rate in the reverberation sound (early reflection sound) or in the reverberation characteristics.

The decay rate data g51, g52, g53, - - - are stored in a register 85, and are input to multipliers 86, 86, - - - . The multipliers 86, - - - multiply the input tone data by the decay rate data g51, g52, g53, - - - so as to be decayed by small amounts. Therefore, the decay rate data g51, g52, g53, - - - determines the magnitude of decay, amount and of decay or decay rate in the reverberation sound (late reverberation sound) or in the reverberation characteristics.

The outputs of the tap delay circuits 83, 83, - - - and multipliers 86, 86, - - - are added up and synthesized through the adders 87, - - - and are fed back to the tap delay circuits 83, 83, - - - . Therefore, the generated late reverberation sound becomes a complex, multiplexed and very broad sound.

The continuation time of reverberation decreases with an increase in the values of the decay rate data g1, g2, g3, - - - , g51, g52, g53, - - - , and the continuation time of reverberation becomes increases with a decrease in the values of the. decay rate data g1, g2, g3, - - - , g51, g52, g53, - - - .

As the values of the delay time data DT1, DT2, DT3, - - - , DT51, DT52, DT53, - - - increase, furthermore, the frequencies of the clock signals ϕ1, ϕ2, ϕ3, - - - increase while the continuation time of reverberation decreases. As the values of the delay time data DT1, DT2, DT3, - - - , DT51, DT52, DT53, - - - decrease, on the other hand, the frequencies of the clock signals ϕ1, ϕ2, ϕ3, - - - , ϕ51, ϕ52, ϕ53, - - - decrease and the continuation time of reverberation increases.

As the values of the delay time data DT1, DT2, DT3, - - - , DT51, DT52, DT53, - - - increase, furthermore, the frequencies of the clock signals ϕ1, ϕ2, ϕ3, - - - , ϕ51, ϕ52, ϕ53, - - - increase, and the number of reverberation sounds increase per a unit time so as to increase the density of reverberation. As the values of the delay time data DT1, DT2 DT3, - - - , DT51, DT52, DT53, - - - decrease, on the other hand, the frequencies of the clock signals ϕ1, ϕ2, ϕ3, - - - , ϕ51, ϕ52, ϕ53, - - - , number of reverberation sounds per a unit time and density of reverberation all decrease.

10. Sound System 53

Figure 11:
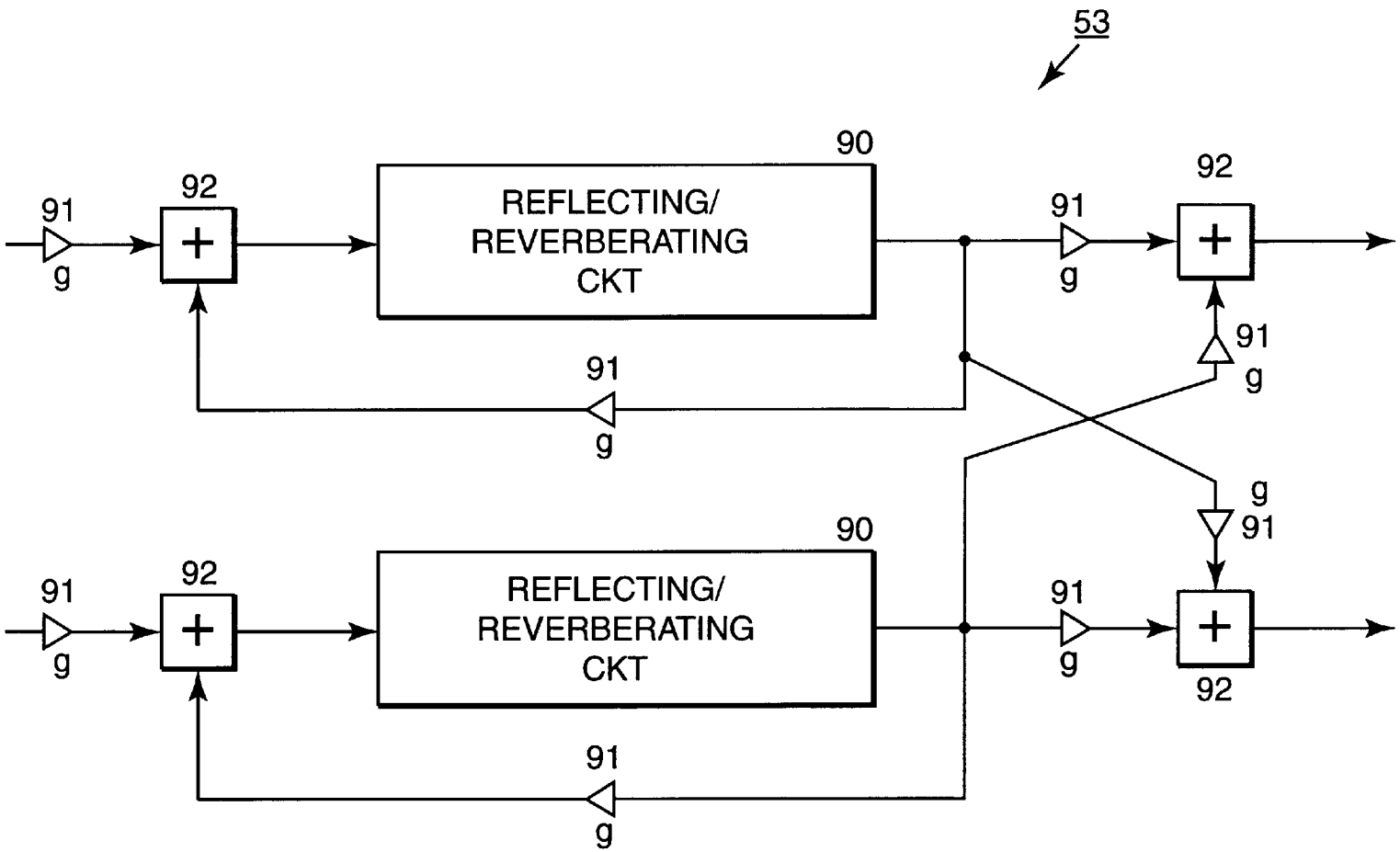
FIG. 11 shows another sound system 53.

FIG. 11 illustrates another sound system 53. A reflecting/reverberating circuit 90 comprises the early reflection sound-forming unit 60, the late reverberation sound-forming unit 80, the early reflection sound-forming unit 60 to which the late reverberation sound-forming unit 80 is connected, or a circuit for one channel of the stereo system of these circuits 60 and 80.

The outputs of the reflecting/reverberating circuits 90, 90 are added up and synthesized together through adders 92, 92, and are fed back through multipliers 91, 91. Accordingly, the two outputs are affected by each other to generate broad tones.

Figure 12:
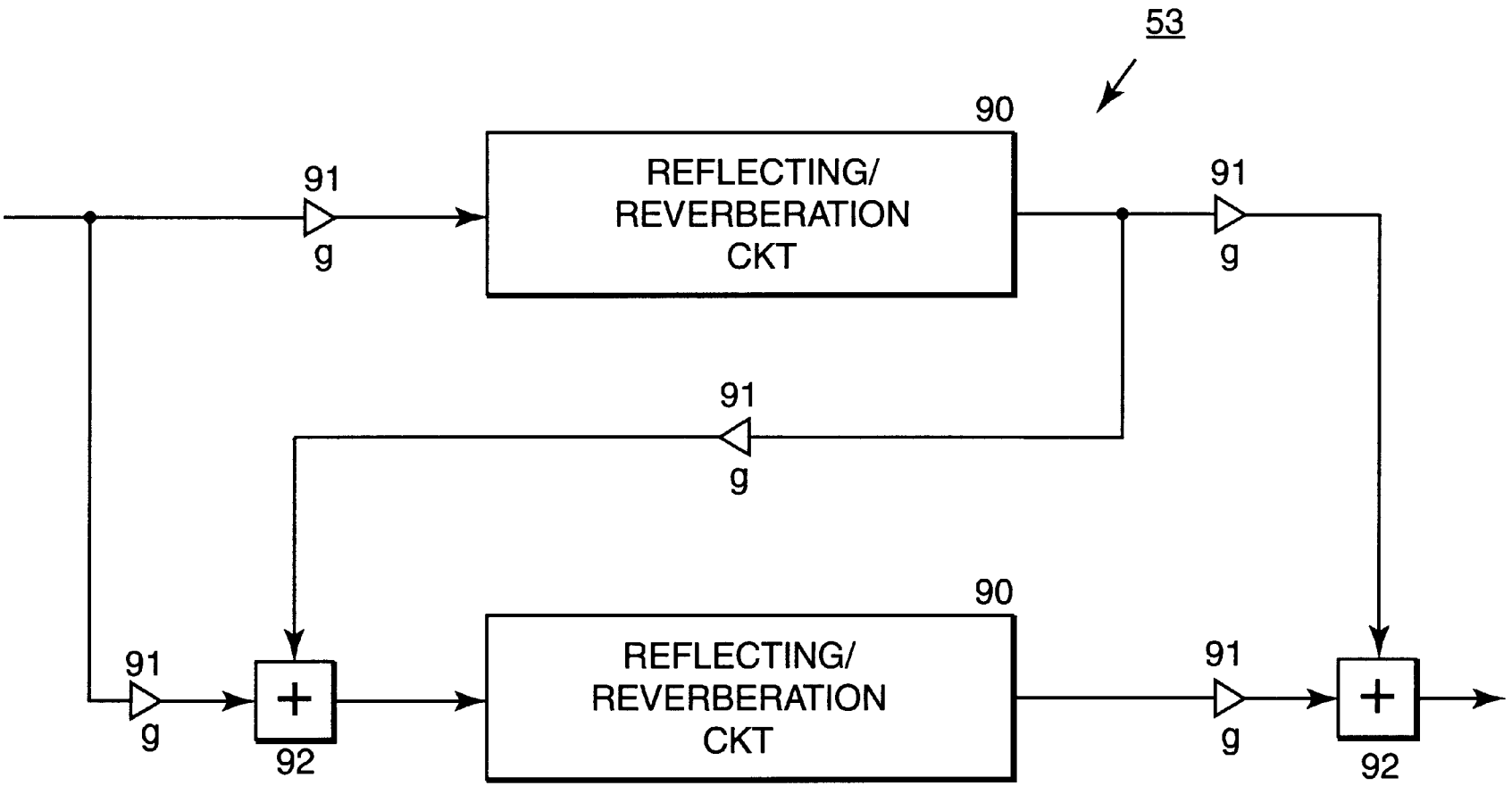
FIG. 12 shows a further sound system 53.

FIG. 12 illustrates a further sound system 53. The reflecting/reverberating circuits 90, 90 receive the same tone data, and their outputs are added up and synthesized together through an adder 92 and are output. Furthermore, the output of one reflecting/reverberating circuit 90 is input to the other reflecting/reverberating circuit 90 through a multiplier 91 and an adder 92. Therefore, one output becomes dependent upon the ether output to generate broad tones.

Figure 13:
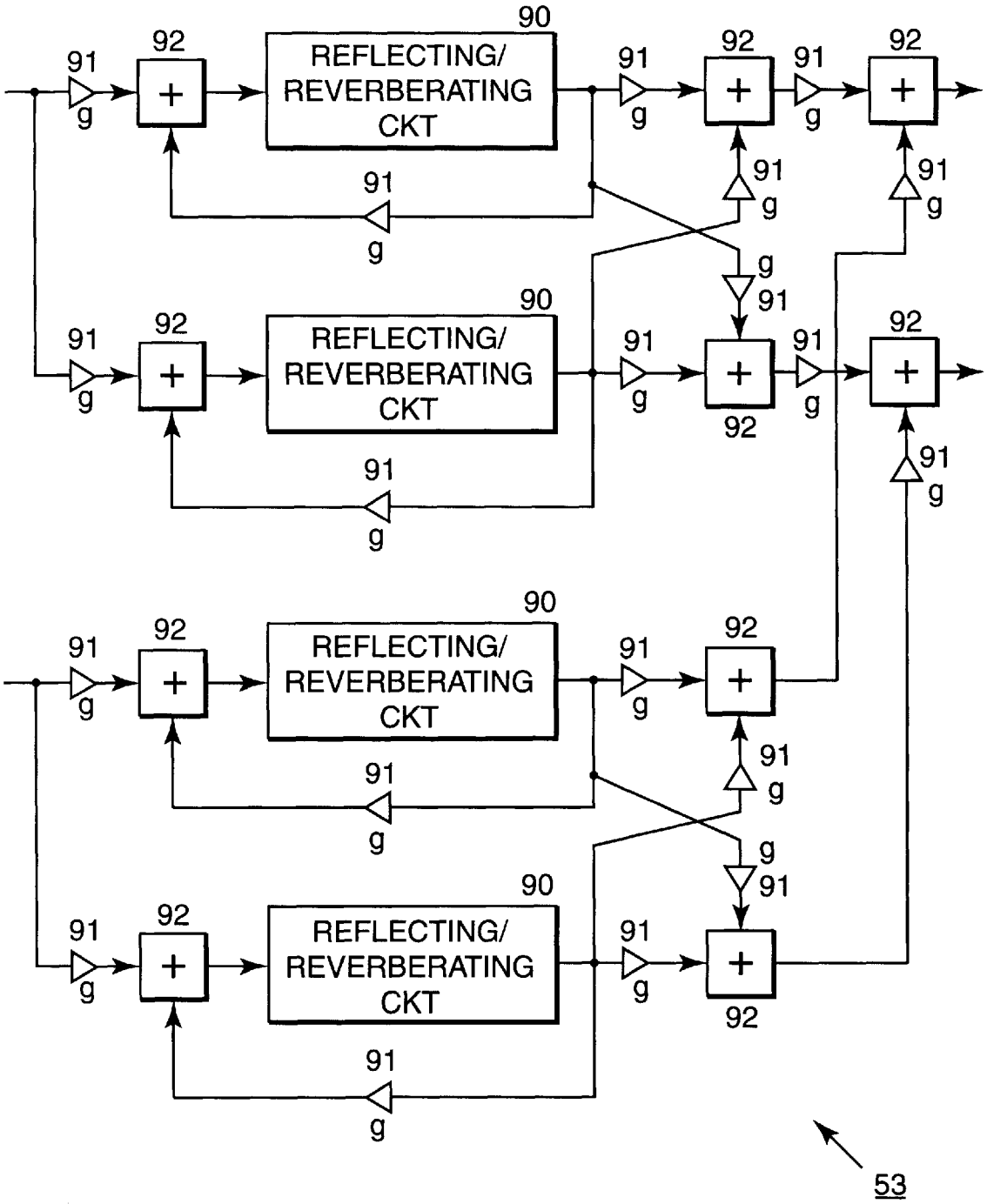
FIG. 13 shows a still further sound system 53.

FIG. 13 illustrates a still further sound system 53. In this case, the circuit of FIG. 11 is duplicated (doubled), and their outputs arc added up and synthesized together through adders 92, 92, and are output. The same tone data are input to the two circuits of FIG. 11. Therefore, the four outputs are affected by each other to generate further multiplexed and broad tones.

As the degree of resonance increases to a high value among the tones being sounded and the data of the resultant resonance relation values also increases, then, the values of the delay timing data DT1, DT2, DT3, - - - , DT51, DT52, DT53, - - - and the density of reverberation correspondingly increase. In this case, furthermore, the values of decay rate data g1, g2, g3, - - - , g51, g52, g53, - - - decrease, and the continuation time of reverberation increases. Depending upon the cases, the characteristics may be reversed, as a matter of course.

As the degree of resonance decreases to a low value among the tones being sounded and the data of the resultant resonance relation values decreases, then, the values of the delay timing data DT1, DT2, DT3, - - - , DT51, DT52, DT53, - - - and the density of reverberation correspondingly decrease. In this case, furthermore, the values of decay rate data g1, g2, g3, - - - , g51, g52, g53, - - - increase, and the continuation time of reverberation decreases or shortens. Depending upon the cases, the characteristics may be reversed, as a matter of course.

The values of the delay timing data DT1, DT2, DT3, - - - , DT51, DT52, DT53, - - - and the values of the decay rate data g1, g2, g3, - - - , g51, g52, g53, - - - vary depending upon the early reflection sound and the late reverberation sound. The values of one side may be larger than, smaller than, or equal to, the values of the other side.

11. Overall Processing

Figure 15:
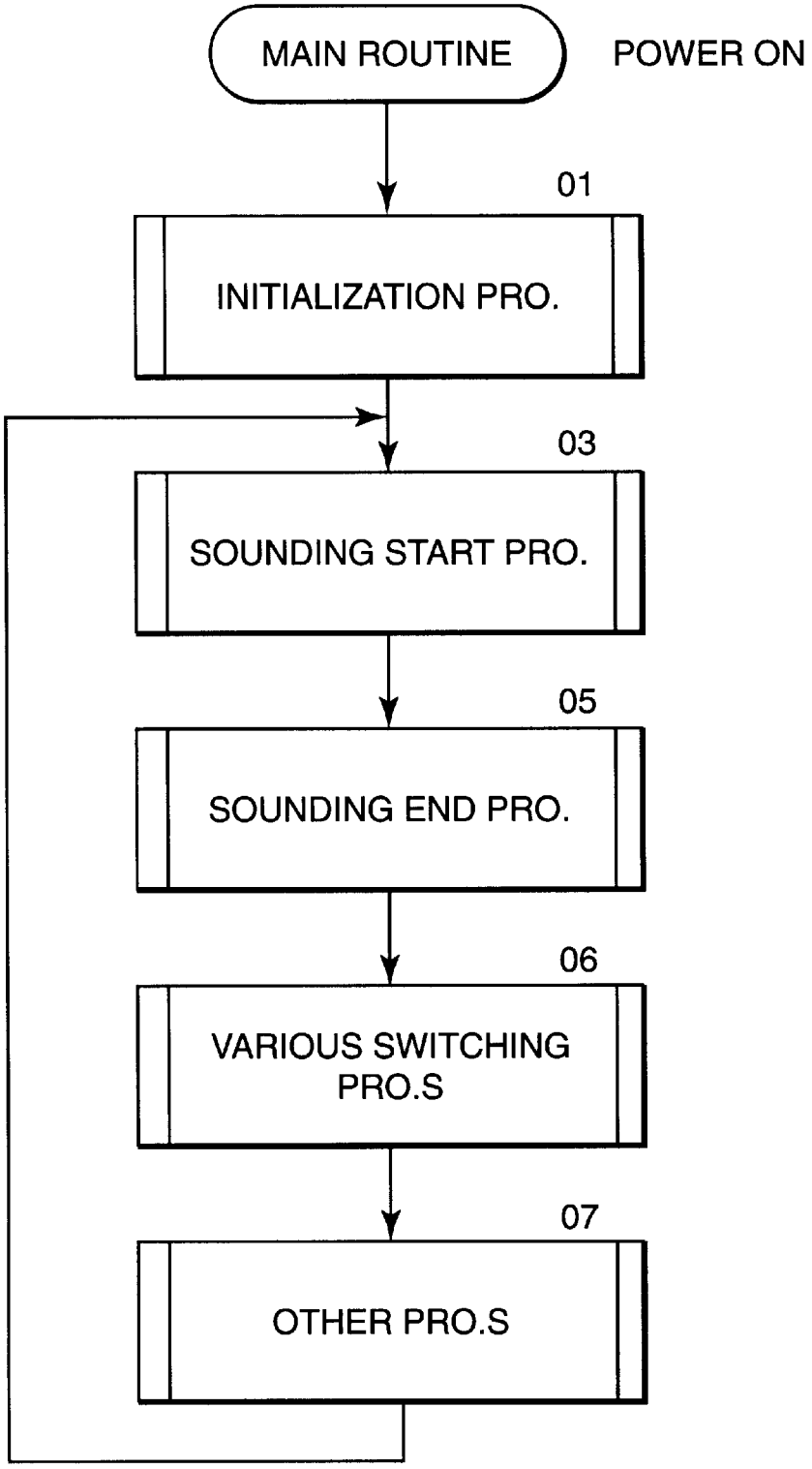
FIG. 15 is a flow chart illustrating the processing in accordance with the present application.

FIG. 15 is a flow chart of the overall processing executed by the controller (CPU) 2. The overall processing is started by the turn-on of the power source of the tone-generating apparatus, and is repetitively executed until the power source is turned off. First, a variety of initialization processings are executed for the program/data storage unit 3 (step 01), and sounding start processing is executed based on the manual play or the automatic play by the performance information-generating unit 1 (step 03)

In the sounding start processing, an empty channel is searched, and a tone related to an on event is assigned to the empty channel that is searched. The content of the tone is determined depending upon the performance information (tone-generating data) from the performance information-generating unit 1, musical factor data in the tone control data, and musical factor data that have been stored already in the program/data storage unit 3.

In this case, on/off data "1", frequency number data FN, envelope speed data ES, envelope time data EL, and envelope phase data EF "0" are written into the area of the assignment memory 40 of the empty channel that is searched. Tone number data TN, touch data TC, part number data PN and tone time data TM "0"are also written to assignment memory 40.

Then, a sounding end (i.e., decay) processing is executed based on the manual play or the automatic play in the performance information-generating unit 1 (step 05). In the sounding end) processing, a channel to which a tone of an off event (i,e., key-off event or sounding end event) is assigned is searched, and the tone is decayed to end the sounding. In this case, the envelope phase of a tone related to the key-off event is released, and the envelope level gradually approaches "0".

Besides, by operating a variety of switches of the performance information-generating unit 1, the musical factor data corresponding to the switches are accessed and stored in the program/data storage unit 3, whereby the musical factor data are changed (step 06). Thereafter, other processing is executed (step 07), and continuously repeated from steps 02 to 07.

12. Sounding Start Processing (step 03)

FIG. 16 is a flow chart of the sounding start processing executed at the step 03. First, when there occurs an on event (step 11), the frequency number ratio data FNR corresponding to the tone number data TN of the tone related to the on event, envelope speed data ES and envelope time data ET are read out from component sound table 30 (step 12).

Then, the FN corresponding to the key number data KN of the tone of direct sound related to the on event is multiplied by the FNR read out, to find the FN of the component sounds (step 13). When there exist a plurality of on events, the frequency number data FN are found for the plurality of component sounds of direct sound.

Then, the FN, ES and ET data of resonance sound for the direct sound is determined (step 14). Here, the values of FN of the resonance sound are equal to the values of FN of the direct sound multiplied by 2 times, 3/2 times, 4/3 times, 5/4 times, - - - , 3 times, 4 times, 5 times, - - - . Therefore, the resonance characteristics (resonance degree) of the resonance sounds vary depending upon the relationship of tone pitches for tones of the direct sounds concurrently generated.

The envelope speed data ES or the envelope level data EL of the resonance sound are equal to the values of ES or EL of the direct sound multiplied by 1/2 times, 2/3 times, 3/4 times, 4/5 times, - - - , 1/3 times, 1/4 times, 1/5 times, - - - (step 14). Thus, the resonance sound has the same tone data TN and the same tone waveform as the direct sound, and the amplitude of the envelope decreases depending upon the proportional conversion described above.

The number (or quantity) of the resonance sounds is limited to a predetermined value. When the resultant value of ES or EL of the thus operated attack of resonance sound exceeds a predetermined value, the processing to form the resonance sound ceases.

The resonance characteristics of the resonance sound can represent a frequency range of resonance for the direct or musical sound, for a resultant level of resonance sounds for the direct sound and/or for a number of resonance sounds for the direct sound.

When the FN of the component sounds assigned already in the assignment memory 40 equal the FN found at step 13 (step 15), the ES and ET of the phases of the channel are changed and stored into the synthesized envelope, and a key number data KN is additionally stored (step 16).

In the synthesized envelope, the envelope of the now component sound is added to and synthesized for the envelop of the single component sound, or the synthesized component sound assigned already to the channel. The processing for synthesizing the envelope at the step 15 has been taught in FIGS. 7A and 7B and corresponding portions of the specifications of Japanese Patent Applications Nos. 12764/1998, 12781/1998 and 16617/1998.

Thus, when the component sound of direct (musical) sound and the component sound of resonance sound have the same frequency, they are synthesized into one sound which is assigned and written into one channel area of the assignment memory 40. In the above-mentioned synthesis, the envelope waveforms are synthesized into one envelope waveform, and the ES and ET are operated for generating the synthesized envelope waveform. Moreover, the resonance characteristics (i,e., degree) of the direct sounds and the resonance sounds vary depending upon the relationship in the tone pitches of not only the concurrently generated direct sounds, but also of the tones of resonance sounds that are also concurrently generated.

Next, the resonance relation value data are found from table 35 of resonance relation values based on all key number data KN written in the assignment memory 40, and the resultant value is found (step 20). Based on this resultant value, the corresponding delay time data DT1, DT2, DT3, DT4, - - - , DT51, DT52, DT53, DT54, and decay rate data g1, g2, g3, g4, - - - , g51, g52, g53, g54, - - - are read out from the reverberation table 31 (step 21), and are sent to the reflecting/reverberating circuit 90 (early reflection sound-forming unit 60, late reverberation sound-forming unit 80) in the sound system 53 (step 22). Then, the content of reverberation, content of delay, delay rate or decay rate is changed and controlled depending upon the resonance characteristics of the simultaneously generated tones, or upon the relationship of tone pitches of the concurrently generated tones.

When the frequency number data FN of the component sounds that have been previously assigned do not equal the FN that is found (step 15), an empty channel is searched (step 23). The number of the empty channel is the first smallest channel number 1MCH stored in the smallest channel memory 134.

Then, the data MLE having the largest value or the data MLE of the lowest sound among the corrected level data MLE multiplied and corrected at the step 82 is compared with the first smallest corrected envelope data 1MEN stored in the smallest channel memory 134 (step 24). When the first smallest corrected envelope data 1MEN is smaller (step 25), the frequency number data FN, key number data KN, envelope speed data ES and envelope time data ET of the component sound are written into the area of the first smallest channel number 1MCH in the assignment memory 40, and the counter of a corresponding channel in the phase counter 50 is cleared (step 27). Thus, the channel to which the component sound has been previously assigned and which has a small level of component sound can be replaced by the component sound having the greatest level.

The first smallest channel number 1MCH and the first smallest corrected envelope data 1MEN of the assigned channel are erased from the smallest channel memory 134 (step 28), the corrected level data MLE of the program/data storage unit 3 (RAM) are erased, too, (step 29), the above-mentioned processing for synthesizing the envelope or the processing for assigning the channels is repeated for other component sounds (step 30), and other processings are executed (step 31).

Thus, the component sounds of small levels assigned to the channels core successively erased, the component sounds having large levels are successively assigned to the channels, arid small and large component sounds are successively replaced.

Figure 17:
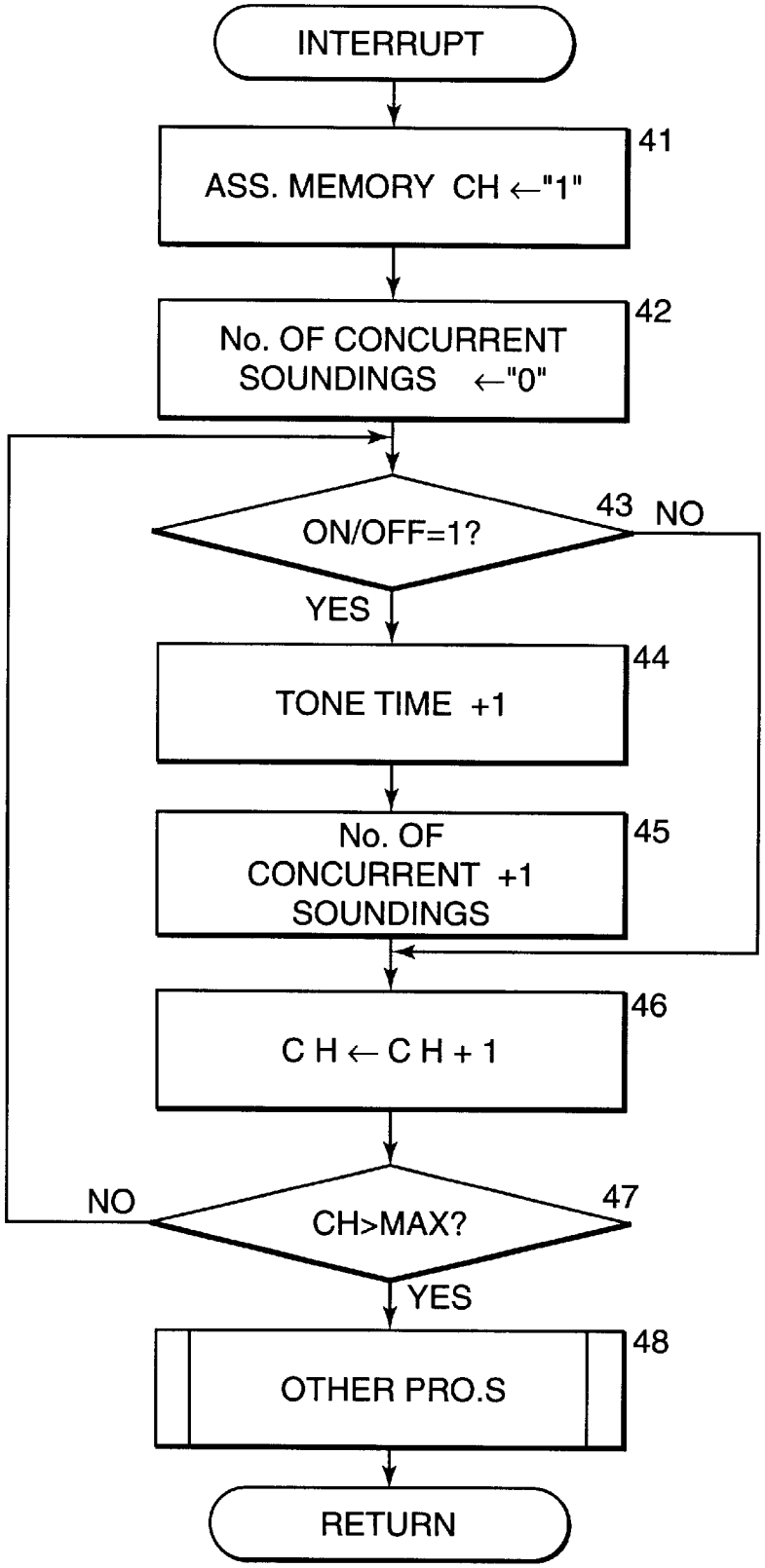
FIG. 17 is a flow chart illustrating an interrupt processing executed after a predetermined period.

13. Processing the Tone Time Data TM and the Number of the Concurrently Generated Sounds FIG. 17 is a flow chart of interrupt processing executed by the controller 2 after every predetermined period. The tone line data TM increases and the number of the concurrently generated sounds is counted. Additionally, in this processing, among the channel areas (steps 41, 46, 47) in the assignment memory 40, the tone time data TM is increased by "+1" (step 44) for the tone having an on/off data of "1" and being sounded (step 43).

Concerning the channel areas of the assignment memory 40 (steps 41, 46, 47), furthermore, the date of the number of the concurrently generated sounds is cleared (step 42), the tones having the on/off data of "1" are counted (step 43), and the number of the concurrently generated sounds is successively increased by "+1" (step 45). This count This count is stored in the program/data storage unit 3.

Then, other periodical processings are executed (step 48). Thus, the sounding passage time of the tone of each channel is counted, stored and utilized as the sounding start time data. Besides, the number of the tones being sounded for all channels is counted, stored and utilized as the data related to the number of the concurrently generated sounds at intervals.

The present invention is not limited to the above-mentioned embodiment, but can be modified in various ways without departing from the scope of the invention. For example, in the above embodiment the values of the delay time data DT1, DT2, DT3, - - - , DT51, DT52, DT53, - - - and/or the values of the decay rate data g1, g2, g3, - - - , g51, g52, g53, - - - are changed DBased upon the data of resultant resonance relation values. These values, however, may be changed depending upon the range of resonance frequencies, number of resonance sounds, or the resultant level of direct sounds and/or resonance sounds.

In this case, when the value of the envelope speed ES of the attack of resonance sound calculated at step 14 decreases to less than a predetermined value, the frequency of this resonance is the farthest from the frequency of the direct sound. Therefore, the "difference" of the frequency number data FN of the resonance sound from the FN of the direct sound represents the above-mentioned "range of resonance frequencies". The delay time data DT1, DT2, DT3, - - - , DT51, DT52, DT53, - - - and decay rate data g1, g2, g3, - - - , g51, g52, g53, - - - in the reverberation table 31 are stored, selected and varied depending upon this "difference". The direct sound in this case is the one (key event) sounded (sounding started) arbitrarily, first or last among a plurality of direct sounds.

When the value of the envelope speed ES of resonance sound calculated at the step 14 becomes smaller than a predetermined value, furthermore, the number of resonance sounds calculated thus far is counted to represent the "number of resonance sounds". The delay time data DT1, DT2, DT3, - - - , DT51, DT52, DT53, - - - and the decay rate data g1, g2, g3, - - - , g51, g52, g53, - - - in the reverberation table 31 can be stored, selected and varied depending upon the "Number of resonance sounds".

Moreover, the ES of attacks of the direct sounds and/or resonance sounds are summed at the step 45. The summed value represents the "summed level of the direct sounds and/or resonance sounds". The delay time data DT1, DT2, DT3, - - - , DT51, DT52, DT53, - - - and the decay rate data g1, g2, g3, - - - , g51, g52, g53, - - - in the reverberation table 31 are stored, selected and changed depending upon the "summed level of the direct sounds and/or resonance sounds".

The tone waveform data MW stored in the waveform memory 42 may have a complex waveform other than the sine wave, or may have a waveform that varies depending upon the timbre, tone pitch (tone pitch range), touch, part or sounding time, and may be stored, changed over or selected. Such complex waveforms are read as tone waveforms of the component sounds and are output.

The tone assigned to each channel may be an independent tone other than the component sounds. In this case, the tones assigned to the same channel have the same waveform and the same tone pitch (frequency). In such a case, too, the envelopes can be synthesized or the amounts of generation can be synthesized in the same manner.

Moreover, what is synthesized may be an amplitude of the tone waveform data MW other than the envelope. In this case, what is synthesized at the step 16 are, for example, touch data TC (i.e., factors for determining amplitude), etc. The TC of channels of the assignment memory 40 are added up for every on event and off event. The added touch data TC are sent to the multiplier 43 from the assignment memory 40 and are used for multiplying the tone waveform data MW. The added touch data TC may be used for multiplying the envelope speed data ES of the channel. The envelopes are synthesized at the step 16 by using the thus multiplied envelope speed data ES.

What is claimed is:

1. A reverberating/resonating apparatus, comprising:

means for generating a musical sound;

means for adding resonance characteristics to the generated musical sound;

means for repetitively delaying the resonance characteristics-influenced musical sound so that the musical sound is imparted with reverberation; and means for determining delay the musical sound based on the resonance characteristics.

2. The apparatus of claim 1, wherein the delay is delay rate or decay rate of the delayed musical sound, as compared to the generated musical sound.

3. The apparatus of claim 1, wherein the resonance characteristics include a range of resonant frequencies for the generated musical sound, sum levels of resonance sounds for the generated musical sound, and numbers of the resonance sounds within the generated musical sound.

4. The apparatus of claim 1, wherein the generated musical sound is delayed at the input of the apparatus and at the output of the apparatus, and wherein the delay of the input and output are different from each other.

5. The apparatus of claim 1, wherein the resonance characteristics are based on the relation of tone pitches of musical tones that are generated together.

6. The apparatus of claim 1, wherein the delay of the resonance characteristics is based on the relation of tone pitches of a plurality of tones that are generated together.

7. The apparatus of claim 1, wherein the musical sound includes a plurality of musical tones that are generated together, and wherein the tones are plural component sounds each consisting of a single musical sound.

8. The apparatus of claim 3, wherein the frequency of resonance sound is a ratio of an integer times of the frequency of the generated musical sound.

9. The apparatus of claim 7, wherein resonance sound is synthesized with the component sound if frequency of the component sound equals frequency of the resonance sound.

10. A reverberating/resonating method, comprising:

generating musical sound;

adding resonance characteristics to the musical sound;

repetitively delaying the resonance characteristics-influenced musical sound so as to impart the musical sound with reverberation;

wherein the delay of the musical sound is based on the resonance characteristics.

11. The method according to the claim 10, wherein the delay is delay rate or decay rate of the delayed musical sound, as compared to the generated musical sound.

12. The method according to the claim 10, wherein the resonance characteristics include a range of resonant frequencies for the generated musical sound, sum levels of resonance sounds for the generated musical sound, and numbers of the resonance sounds within the generated musical sound.

13. The method according to the claim 10, wherein the generated musical sound is delayed at the input of the apparatus and at the output of the apparatus, and wherein the delay at the input and output are different from each other.

14. The method according to the claim 10, wherein the resonance characteristics are based on the relation of tone pitches of musical tones that are generated together.

15. A reverberating/resonating product formed by the process comprising:

adding resonance characteristics to a generated musical sound;

delaying the resonance characteristics-influenced musical sound; and determining delay of the musical sound based on the resonance characteristics.

16. The product of claim 15, wherein the delay is delay rate or decay rate of the delayed musical sound, as compared to the generated musical sound.

17. The product of claim 15, wherein the resonance characteristics include a range of resonant frequencies for the generated musical sound, sum levels of resonance sounds for the generated musical sound, and numbers of the resonance sounds within the generated musical sound.

18. The product of claim 15, wherein the generated musical sound is delayed at an input to and at the output from a reverberating/resonating device, and wherein the delay at the input and output are different from each other.

* * * * *